US008133089B2

(12) United States Patent
Amireh et al.

(10) Patent No.: US 8,133,089 B2
(45) **Date of Patent: *Mar. 13, 2012**

(54) MODULAR TOY AIRCRAFT WITH CAPACITOR POWER SOURCES

(75) Inventors: Nicholas Amireh, Los Angeles, CA (US); Paulo Kang, Pasadena, CA (US); David Strom, Redondo Beach, CA (US); Chi Keung Chui, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 490 days.

This patent is subject to a terminal disclaimer.

(21) Appl. No.: 11/740,216

(22) Filed: Apr. 25, 2007

(65) Prior Publication Data

US 2008/0014827 A1 Jan. 17, 2008

Related U.S. Application Data

(60) Provisional application No. 60/797,467, filed on May 3, 2006, provisional application No. 60/814,471, filed on Jun. 15, 2006, provisional application No. 60/846,056, filed on Sep. 19, 2006, provisional application No. 60/845,996, filed on Sep. 19, 2006, provisional application No. 60/859,122, filed on Nov. 14, 2006, provisional application No. 60/859,124, filed on Nov. 14, 2006.

(51) Int. Cl.
*A63H 27/00* (2006.01)

(52) U.S. Cl. ..... 446/58; 446/57

(58) Field of Classification Search ..... 446/33, 446/34, 57–60

See application file for complete search history.

(56) References Cited

U.S. PATENT DOCUMENTS

| | | | | |
|---|---|---|---|---|
| 1,827,438 | A | | 10/1931 | Rauch |
| 1,842,125 | A | * | 1/1932 | Schwarz ..... 244/51 |
| 2,131,490 | A | | 9/1938 | Walker |
| 2,347,561 | A | | 4/1944 | Howard |
| 2,361,929 | A | | 11/1944 | Florez |
| 2,437,743 | A | | 3/1948 | Hojnowski |
| 2,543,516 | A | | 2/1951 | Walker |
| 3,246,861 | A | | 4/1966 | Curci |

(Continued)

FOREIGN PATENT DOCUMENTS

CN 2229292 Y 6/1996

(Continued)

OTHER PUBLICATIONS

Sep. 10, 2007 European Search Report; Application No. 07107429.8-2318 (EP 1852166A1).

(Continued)

*Primary Examiner* — Gene Kim
*Assistant Examiner* — Alyssa Hylinski
(74) *Attorney, Agent, or Firm* — Kolisch Hartwell, PC

(57) ABSTRACT

Toy aircraft, modular toy aircraft, capacitor-based modular power systems, and toy aircraft kits are disclosed. Toy aircraft may include a self-contained power system and an airframe. The self-contained power system may include at least one propulsion unit operable to propel the toy aircraft and a power unit. The power unit may include a capacitor that is electrically connected to the at least one propulsion unit. The capacitor may be configured to provide power to the at least one propulsion unit to propel the toy aircraft. The airframe may include a wing, a first mount configured to removably retain the at least one propulsion unit, and a second mount configured to removably retain the power unit.

20 Claims, 9 Drawing Sheets

U.S. PATENT DOCUMENTS

| | | | | |
|---|---|---|---|---|
| 3,369,319 | A | 2/1968 | Brown | |
| 3,629,680 | A | 12/1971 | Baynes et al. | |
| 3,748,564 | A | 7/1973 | Ohba | |
| 3,777,420 | A | 12/1973 | Bosley et al. | |
| 3,796,005 | A | 3/1974 | Chang et al. | |
| 3,806,939 | A | 4/1974 | Palmieri | |
| 3,861,623 | A | 1/1975 | Fruechte | |
| 3,871,126 | A | 3/1975 | Miller | |
| 3,898,765 | A | 8/1975 | Lee | |
| 3,937,424 | A | 2/1976 | Meier et al. | |
| 3,957,230 | A | 5/1976 | Boucher et al. | |
| 4,009,849 | A | 3/1977 | Eickmann | |
| 4,038,590 | A | 7/1977 | Knowlton | |
| 4,067,139 | A | 1/1978 | Pinkerton et al. | |
| 4,072,898 | A | 2/1978 | Hellman et al. | |
| 4,143,307 | A | 3/1979 | Hansen et al. | |
| 4,168,468 | A | 9/1979 | Mabuchi et al. | |
| 4,194,317 | A | 3/1980 | Kidd | |
| 4,198,779 | A | 4/1980 | Kress | |
| 4,203,250 | A * | 5/1980 | Garofalo | 446/61 |
| 4,206,411 | A | 6/1980 | Meyer | |
| 4,253,897 | A | 3/1981 | Pistone | |
| 4,270,307 | A | 6/1981 | Arigaya | |
| 4,275,394 | A | 6/1981 | Mabuchi et al. | |
| 4,332,103 | A | 6/1982 | Shulman | |
| 4,563,626 | A | 1/1986 | Ohtake | |
| 4,591,114 | A | 5/1986 | Block | |
| 4,636,178 | A | 1/1987 | Oda | |
| 4,760,392 | A | 7/1988 | Yamamoto et al. | |
| 4,765,567 | A | 8/1988 | Gutman et al. | |
| 4,781,642 | A | 11/1988 | Stanzel | |
| 4,891,029 | A | 1/1990 | Hutchinson | |
| 4,932,916 | A * | 6/1990 | Blickle | 446/124 |
| 4,964,598 | A | 10/1990 | Berejik et al. | |
| 5,035,382 | A | 7/1991 | Lissaman et al. | |
| 5,046,979 | A | 9/1991 | Ragan et al. | |
| 5,078,638 | A | 1/1992 | Molina | |
| 5,087,000 | A * | 2/1992 | Suto | 244/189 |
| 5,100,153 | A | 3/1992 | Welte | |
| 5,129,852 | A | 7/1992 | Crisci et al. | |
| 5,328,401 | A | 7/1994 | DeMars | |
| 5,330,131 | A | 7/1994 | Burcham et al. | |
| 5,334,076 | A | 8/1994 | Shinozuka | |
| 5,498,951 | A | 3/1996 | Okamura et al. | |
| 5,507,455 | A | 4/1996 | Yang | |
| 5,525,087 | A | 6/1996 | Hsu | |
| 5,602,553 | A | 2/1997 | Polan | |
| 5,629,590 | A | 5/1997 | Yamamoto | |
| 5,634,839 | A | 6/1997 | Dixon | |
| 5,672,086 | A | 9/1997 | Dixon | |
| 5,768,955 | A | 6/1998 | Hauser | |
| 5,769,359 | A | 6/1998 | Rutan et al. | |
| 5,785,281 | A | 7/1998 | Peter et al. | |
| 5,799,045 | A | 8/1998 | Sakuma et al. | |
| 5,810,284 | A | 9/1998 | Hibbs et al. | |
| 5,850,597 | A | 12/1998 | Tanaka et al. | |
| 5,853,312 | A | 12/1998 | Li | |
| 5,890,441 | A | 4/1999 | Swinson et al. | |
| 5,906,335 | A | 5/1999 | Thompson | |
| 5,925,992 | A | 7/1999 | Orton | |
| 5,932,992 | A | 8/1999 | Tomatsu et al. | |
| 5,995,884 | A | 11/1999 | Allen et al. | |
| 6,102,330 | A | 8/2000 | Burken et al. | |
| 6,130,513 | A | 10/2000 | Orton | |
| 6,217,404 | B1 | 4/2001 | Liao | |
| 6,257,525 | B1 | 7/2001 | Matlin et al. | |
| 6,257,946 | B1 | 7/2001 | Yang | |
| 6,445,333 | B1 | 9/2002 | Tanaka | |
| 6,478,650 | B1 | 11/2002 | Tsai | |
| 6,520,823 | B2 | 2/2003 | Tian et al. | |
| 6,520,824 | B1 | 2/2003 | Caroselli | |
| 6,550,715 | B1 | 4/2003 | Reynolds et al. | |
| 6,568,980 | B2 | 5/2003 | Barthold | |
| 6,609,945 | B2 | 8/2003 | Jimenez | |
| 6,612,893 | B2 * | 9/2003 | Rehkemper et al. | 446/34 |
| 6,688,936 | B2 | 2/2004 | Davis | |
| 6,688,937 | B1 | 2/2004 | Tsai | |
| D495,376 | S | 8/2004 | Zee | |
| 6,769,949 | B2 | 8/2004 | Kim et al. | |
| 6,843,699 | B2 | 1/2005 | Davis | |
| 6,847,865 | B2 | 1/2005 | Carroll | |
| 6,899,586 | B2 | 5/2005 | Davis | |
| 6,918,627 | B2 * | 7/2005 | Mataja et al. | 296/177 |
| D508,094 | S | 8/2005 | Khasminsky | |
| 6,965,816 | B2 | 11/2005 | Walker | |
| 7,011,274 | B1 | 3/2006 | Hardoin | |
| 7,073,750 | B1 * | 7/2006 | Choi | 244/13 |
| 7,811,150 | B2 * | 10/2010 | Amireh et al. | 446/58 |
| 2002/0106961 | A1 | 8/2002 | Barthold | |
| 2002/0134883 | A1 * | 9/2002 | Stamps et al. | 244/7 R |
| 2003/0027486 | A1 | 2/2003 | LaPointe et al. | |
| 2003/0040247 | A1 | 2/2003 | Rehkemper et al. | |
| 2003/0197092 | A1 | 10/2003 | Tian et al. | |
| 2004/0077284 | A1 | 4/2004 | Bonilla | |
| 2004/0195438 | A1 | 10/2004 | Chamberlain | |
| 2005/0151023 | A1 | 7/2005 | Ribbe | |
| 2005/0173589 | A1 | 8/2005 | Davis | |
| 2005/0191930 | A1 | 9/2005 | Foster et al. | |
| 2005/0233672 | A1 | 10/2005 | Shantz | |
| 2006/0144994 | A1 | 7/2006 | Spirov | |
| 2006/0178078 | A1 | 8/2006 | Tsai et al. | |
| 2007/0037468 | A1 | 2/2007 | Ong | |
| 2007/0259595 | A1 | 11/2007 | Amireh et al. | |

FOREIGN PATENT DOCUMENTS

| | | | |
|---|---|---|---|
| CN | 2573038 | Y | 9/2003 |
| CN | 1568212 | A | 1/2005 |
| DE | 24 11 148 | A1 | 9/1975 |
| DE | 3234935 | A1 | 3/1984 |
| DE | 19931911 | A1 | 7/2007 |
| EP | 0019448 | A1 | 11/1980 |
| EP | 0452646 | A1 | 10/1991 |
| EP | 1852166 | A1 | 11/2007 |
| EP | 1852167 | A1 | 11/2007 |
| FR | 2236237 | | 1/1975 |
| FR | 2387066 | | 11/1978 |
| GB | 1262647 | | 2/1972 |
| GB | 1440338 | | 6/1976 |
| GB | 2329345 | A | 3/1999 |
| GB | 2359286 | A | 8/2001 |
| JP | 2005040407 | A | 2/2005 |
| WO | 94/08847 | | 4/1994 |
| WO | WO 01/03790 | A1 | 1/2001 |
| WO | WO 0103790 | A1 * | 1/2001 |
| WO | 01/91871 | | 6/2001 |
| WO | 01/58756 | A2 | 8/2001 |
| WO | 02/04289 | A1 | 1/2002 |
| WO | WO 02/072222 | | 9/2002 |
| WO | WO 2004/045735 | | 6/2004 |
| WO | 2004/080556 | A2 | 9/2004 |
| WO | 2004/080556 | A3 | 9/2004 |
| WO | 2004/101357 | A2 | 11/2004 |

OTHER PUBLICATIONS

Zhang Wenping; Office action received in corresponding Chinese Patent Application No. 200710128101.7; Feb. 6, 2009; State Intellectual Property Office of P.R.C.; China.

Castle Creations, Pixie-14 User Guide, Jan. 2000.

Kid Galaxy, R/C KG Flyer Instructions, 2004.

Steven Sarns; Teaching a Computer to Fly; RC Modeler; Oct. 1999, pp. 14, 16,18, 20, 22, 24, 26, 28, 30, 32.

Worth, John, Cloud 9—Ultracapacitors, RC Microflight, Jun. 2000, p. 12.

Eichenberg, Dennis, Hybrid Power Management: Ultracapacitors offer numerous advantages over rechargeable batteries, NASA Techbriefs, National Aeronautics and Space Administration, Dec. 2005, pp. 10-11.

Brown et al., Ultracapacitors Store Energy in a Hybrid Electrical Vehicle: Capacitors are superior to batteries with respect to energy density, longevity, and performance, NASA Tech Briefs, National Aeronautics and Space Administration, Apr. 2000, pp. 63-64.

United States Statutory Invention Registration; Reg. No. H628; Published Apr. 4, 1989 Inventor: McIngvale.

United States Statutory Invention Registration; Reg. No. H1469; Published Aug. 1, 1995 Inventor: Simonoff.

HOBBICO, Sky Zap RC Plane Instruction Manual, 2001.
Homebuilt X-Twin/AeroAce Powered Micro Jets Discussion from http://www.rcgroups.com/forums dated Feb. 13, 2006 to Feb. 14, 2006.
Lee, Mike, Product Review: B-2 Electric ARF, RC Modeler, Aug. 1999, pp. 60, 62, 64, 66.
RC Microflight, Feb. 2003, p. 12.
RC Modeler, May 1999, p. 115.
Ross, Don, Flying Models, 1998, pp. 152-157, Markowski International Publishers, Hummelstown, PA.
Tyco, Tyco Catalog, 1993, p. 20, USA.
"Air Hogs Dragon Fighter" Discussion from http://www.rcgroups.com/forums dated Aug. 5, 2006 to Sep. 4, 2006.
HOBBICO, *Swift Flyer Plane Instruction Manual*, 2003.
"I picked up an Airhog you might not of heard of" Discussion from http://www.rchangout.com/forums dated Sep. 7, 2006 to Sep. 13, 2006.
Two (2) Photographs of Air Hogs Room Raider Packaging.
Shoei, *Cylinder Type PAS Product Capacitor Brochure*, 2006.
Wikipedia, *Supercapacitor*, http://en.wikipedia.org/wiki/Supercapacitor; printed Sep. 12, 2006.
Office action dated May 29, 2009 from U.S. Appl. No. 11/740,391.
Examining Division of the European Patent Office, Communication Under Rule 71(3) EPC of Intent to Grant European Patent from EP Application No. 07107457.9-2318, May 5, 2009, European Patent Office, Munich Germany.
International Search Report and Written Opinion for Application No. PCT/US2008/058941.
Sep. 6, 2007 European Search Report; Application No. 07107457.9-2318.
Canadian Intellectual Property Office; Office Action issued in corresponding Canadian Patent Application Serial No. 2,587,315; dated Apr. 6, 2009.
Instituto Mexicano de la Propiedad Industrial; Office Action issued in corresponding Mexican Patent Application Serial No. MX/a/2007/005248; dated Jul. 7, 2009.
Basham, Ringe y Correa S.C.; Foreign agent's summary of Office Action issued Jul. 7, 2009 in corresponding Mexican Patent Application Serial No. MX/a/2007/005248; dated Aug. 4, 2009.
Patent Office of the People's Republic of China; Notification of Fulfilling of Registration Formality issued in counterpart Chinese Patent Application Serial No. 200710128101.7, dated Aug. 14, 2009.
USPTO; Office Action from U.S. Appl. No. 11/740,391, dated Jan. 7, 2010.
Liu, Shen & Associates; Chinese agent's comments regarding Office Action issued Jan. 29, 2010, in Chinese Patent Application Serial No. 200710126630.3; dated Mar. 3, 2010.
Zhang Wenping; Office action issued in Chinese Patent Application No. 200710126630.3; dated Jan. 29, 2010; State Intellectual Property Office of P.R.C.; China.
Canadian Intellectual Property Office, Office Action, Mar. 22, 2010, 1 page.

* cited by examiner

MODULAR TOY AIRCRAFT WITH CAPACITOR POWER SOURCES

This application claims priority to U.S. Provisional Patent Application Ser. Nos. 60/797,467, filed on May 3, 2006 and entitled "MODULAR REMOTELY CONTROLLED AIRCRAFT;" 60/814,471, filed on Jun. 15, 2006 and entitled "MODULAR REMOTELY CONTROLLED AIRCRAFT;" 60/846,056, filed on Sep. 19, 2006 and entitled "MODULAR REMOTELY CONTROLLED VEHICLES;" 60/845,996, filed on Sep. 19, 2006 and entitled "MODULAR TOY VEHICLES WITH CAPACITOR POWER SOURCE;" 60/859,122, filed on Nov. 14, 2006 and entitled "MODULAR REMOTELY CONTROLLED VEHICLES;" and 60/859,124, filed on Nov. 14, 2006 and entitled "MODULAR TOY VEHICLES WITH CAPACITOR POWER SOURCE." The complete disclosure of the above-identified patent application is hereby incorporated by reference for all purposes.

BACKGROUND OF THE DISCLOSURE

Examples of toy aircraft are disclosed in U.S. Pat. Nos. 3,957,230, 4,206,411, 5,046,979, 5,078,638, 5,087,000, 5,634,839, 6,612,893, and 7,073,750 and in U.S. Patent Application Publication Nos. 2004/0195438 and 2006/0144995. Examples of toy aircraft fabricated from interconnected flat panels are disclosed in U.S. Pat. Nos. 2,347,561, 2,361,929, 3,369,319, 4,253,897, 5,853,312, 6,217,404, 6,257,946, and 6,478,650. Examples of toy aircraft powered by rechargeable capacitors are disclosed in U.S. Pat. No. 6,568,980 and in International Publication No. WO 2004/045735. Examples of electric double-layer and polyacene capacitors are disclosed in U.S. Pat. Nos. 5,172,307 and 5,369,546. The complete disclosures of these and all other publications referenced herein are incorporated by reference in their entirety for all purposes.

SUMMARY OF THE DISCLOSURE

The present disclosure is directed to toy aircraft, modular toy aircraft, capacitor-based modular power systems, and toy aircraft kits.

Some examples of toy aircraft may include a self-contained power system and an airframe. The self-contained power system may include at least one propulsion unit operable to propel the toy aircraft and a power unit. The power unit may include a capacitor that is electrically connected to the at least one propulsion unit. The capacitor may be configured to provide power to the at least one propulsion unit to propel the toy aircraft. The airframe may include a wing, a first mount configured to removably retain the at least one propulsion unit, and a second mount configured to removably retain the power unit.

Some examples of modular toy aircraft may include a fuselage having first and second sides, a wing connected to the fuselage, a first motor unit, a first propeller driven by the first motor unit, a second motor unit, a second propeller driven by the second motor unit, a power unit, a first motor unit mount, a second motor unit mount, and a power unit mount. The wing may include first and second portions extending from respective first and second sides of the fuselage. The power unit may include a capacitor electrically connected to at least one of the first and second motor units. The capacitor may be configured to deliver current to at least one of the first and second motor units to propel the modular toy aircraft. The first motor unit mount may be disposed on the first portion of the wing and may be configured to removably receive the first motor unit in at least one first predetermined orientation relative to the wing. The second motor unit mount may be disposed on the second portion of the wing and may be configured to removably receive the second motor unit in at least one second predetermined orientation relative to the wing. The power unit mount may be disposed on the fuselage and may be configured to removably retain the power unit in a third predetermined orientation relative to the fuselage.

Some examples of capacitor-based modular power systems may include a first motor unit, a second motor unit, and a power unit. The first motor unit may include a first housing, a first motor disposed within the first housing, and a first propeller driven by the first motor. The second motor unit may include a second housing, a second motor disposed within the second housing, and a second propeller driven by the second motor. The power unit may include a third housing and a capacitor disposed within the third housing. The capacitor may be electrically connected to the first and second motors.

Some examples of toy aircraft kits may include a capacitor-based modular power system, a toy aircraft airframe, and a charging unit. The capacitor-based modular power systems may include a first motor unit, a second motor unit, and a power unit. The toy aircraft may include a fuselage, a wing configured to extend from the fuselage, a first mount disposed on the wing and configured to removably retain the first motor unit, a second mount disposed on the wing and configured to removably retain the second motor unit, and a third mount disposed on the fuselage and configured to removably retain the power unit. The charging unit may include a fourth housing configured to receive at least one battery.

DETAILED DESCRIPTION

Figure 1:
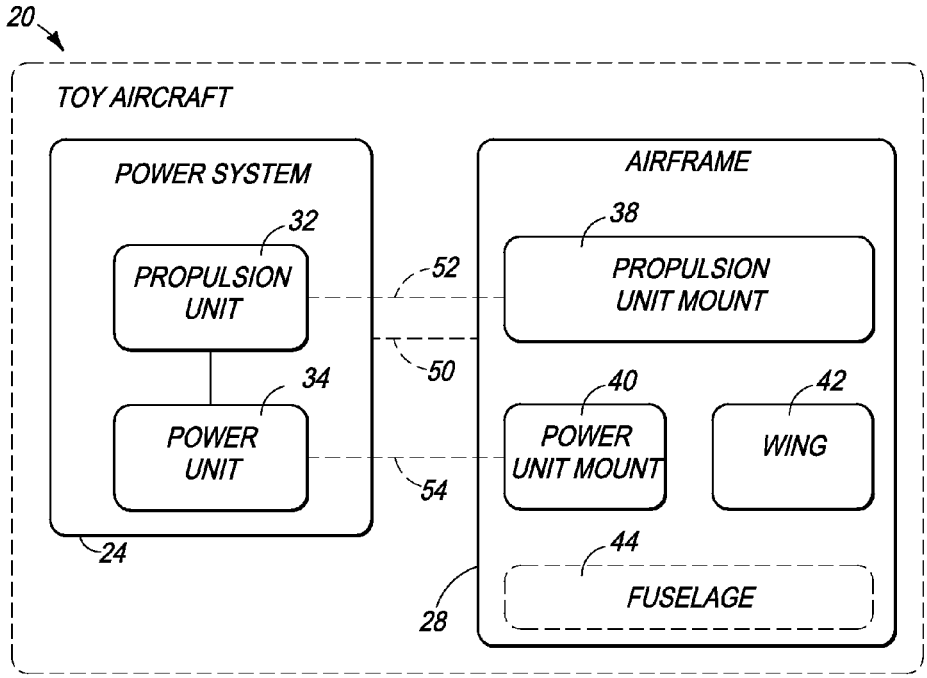
FIG. 1 is a block diagram of a toy aircraft according to the present disclosure.

A nonexclusive illustrative example of a toy aircraft according to the present disclosure is shown schematically in FIG. 1 and indicated generally at 20. Unless otherwise specified, toy aircraft 20 may, but is not required to, contain at least one of the structure, components, functionality, and/or variations described, illustrated, and/or incorporated herein. A toy aircraft 20 according to the present disclosure may include a power system 24 and an airframe 28.

As shown in the nonexclusive illustrative example presented in FIG. 1, power system 24 may include at least one propulsion unit 32 and a power unit 34. As will be more fully discussed below, power unit 34 may be configured to supply power to the at least one propulsion unit 32 such that the at least one propulsion unit 32 is operable to propel toy aircraft 20. As indicated in solid lines in FIG. 1, it is within the scope of the present disclosure for power system 24 to be a discrete or self-contained power system for a toy aircraft. By "discrete," it is meant that the discrete component is not integrally formed with the other component even though the components thereafter may be coupled or otherwise secured together. By "self-contained," it is meant that the self-contained component is adapted to exist and/or at least partially function as a complete or stand-alone unit. For example, a self-contained component may be adapted to exist and/or at least partially function independent of any components external to the self-contained component. Thus, a self-contained power system, such as power system 24, may be adapted to exist and/or function as a complete or stand-alone unit that is independent of a particular toy aircraft 20 and/or a particular airframe 28. For example, as shown in the nonexclusive illustrative example of a self-contained power system presented in FIG. 1, power system 24 may include one or more discrete but linked and/or connected units, such as at least one propulsion unit 32 and a power unit 34, that is/are adapted to be mated to, and/or engaged with, a suitable airframe 28.

As shown in the nonexclusive illustrative example presented in FIG. 1, airframe 28 may include at least one first or propulsion unit mount 38, at least one second or power unit mount 40, and at least one wing 42. In some embodiments, airframe 28 may additionally or alternatively include at least one fuselage 44. Thus, it is within the scope of the present disclosure for toy aircraft 20 to either have both at least one wing and at least one fuselage or to have at least one wing and no fuselage, such as where toy aircraft 20 is configured as a flying-wing aircraft.

Each of the at least one propulsion unit mounts 38 may be configured to removably retain at least one propulsion unit relative to airframe 28. By "removably," it is meant that, even though the retaining component is capable of optionally permanently retaining the retained component, the retained component may optionally be repeatedly retained by and/or removed from the retaining component without permanent and/or destructive alteration to the retaining component, the retained component, and/or the engagement therebetween. In some nonexclusive illustrative examples of toy aircraft 20, at least one of the at least one propulsion unit mounts 38 may be configured to removably retain at least one propulsion unit relative to the wing 42.

The power unit mount 40 may be configured to removably retain at least one power unit relative to airframe 28. In some nonexclusive illustrative examples of toy aircraft 20 that include at least one fuselage 44, the power unit mount 40 may be configured to removably retain at least one power unit relative to at least one of the at least one fuselages of toy aircraft 20.

As indicated in dashed lines in FIG. 1, a toy aircraft 20 according to the present disclosure may be formed, created, and/or assembled when a power system 24 is mated to, and/or engaged with, a suitable airframe 28. A suitable airframe 28 may be any airframe configured to removably retain a power system 24, as indicated by line 50. For example, as shown in the nonexclusive illustrative example presented in FIG. 1, a suitable airframe 28 may include at least one propulsion unit mount 38 configured to removably retain at least one of the at least one propulsion units 32 of power system 24, as indicated by line 52, and at least one power unit mount 40 configured to removably retain the power unit 34 of power system 24, as indicated by line 54.

In some nonexclusive illustrative examples, power system 24 may be a self-contained modular power system for a toy aircraft. By "modular," it is meant that the modular system includes one or more components, where at least a portion of each component has a predetermined geometry that is configured to engage and be retained by a corresponding mount on and/or in a structure that may be discrete from the modular system. For example, a propulsion unit 32 of a self-contained modular power system may be configured to engage and be removably retained on any suitable airframe 28 by a corresponding propulsion unit mount 38, which is configured to engage and removably retain the propulsion unit 32. Correspondingly, a power unit 34 of a self-contained modular power system may be configured to engage and be removably retained on any suitable airframe 28 by a corresponding power unit mount 40, which is configured to engage and removably retain the power unit 34.

Figure 2:
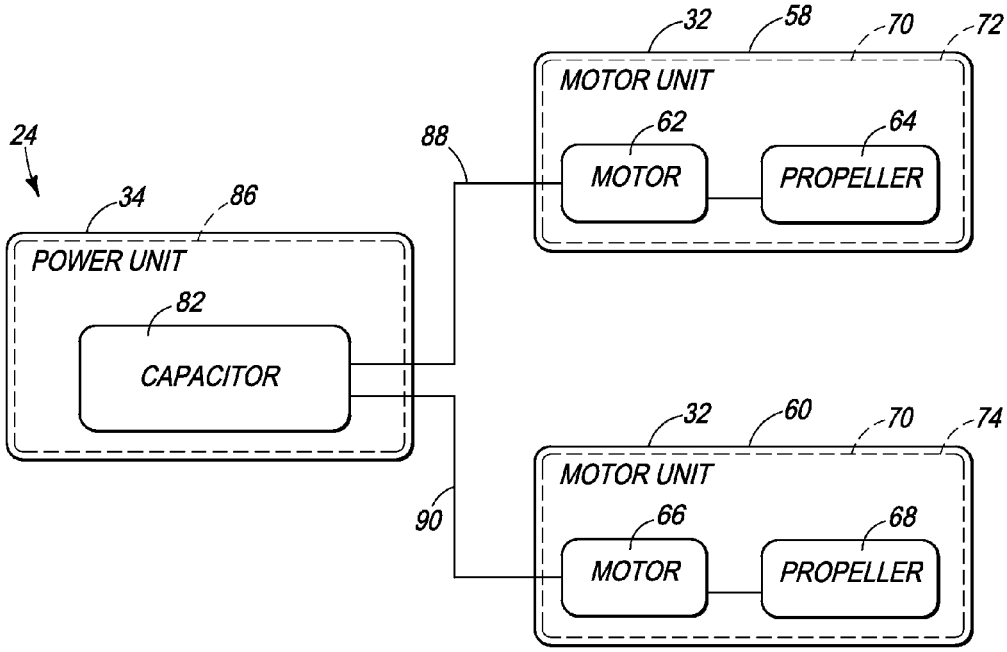
FIG. 2 is a block diagram of a capacitor-based modular power system suitable for use with the toy aircraft of FIG. 1.

A nonexclusive illustrative example of a self-contained or modular power system according to the present disclosure is shown schematically in FIG. 2 and indicated generally at 24. Unless otherwise specified, power system 24 may, but is not required to, contain at least one of the structure, components, functionality, and/or variations described, illustrated, and/or incorporated herein. A modular power system 24 according to the present disclosure may include a power unit 34 and at least one propulsion unit 32. As shown in the nonexclusive illustrative example presented in FIG. 2, modular power system 24 may include a pair of propulsion units 32, such as a first propulsion or motor unit 58 and a second propulsion or motor unit 60.

Each of the propulsion units 32 may include a motor and a thrust generating device, such as one or more propellers or ducted fans, that is driven by the motor. For example, as shown in the nonexclusive illustrative example presented in FIG. 2, first motor unit 58 may include a first motor 62, which drives a first propeller 64, and second motor unit 60 may include a second motor 66, which drives a second propeller 68. In some nonexclusive illustrative examples, at least one of the first and second motors may be an electric motor. In some nonexclusive illustrative examples, at least one of the propulsion units 32 may include a housing 70. For example, the first motor unit 58 may include a first housing 72 within which the first motor 62 is at least partially disposed. The second motor unit 60 may include a second housing 74 within which the second motor 66 is at least partially disposed.

Power unit 34 may include a capacitor 82 such that modular power system 24 is a capacitor-based self-contained or modular power system. As shown in the nonexclusive illustrative example presented in FIG. 2, the capacitor 82 is electrically connected to at least one of the first and second motors 62, 66, such that the capacitor 82 is configured to provide and/or deliver power and/or current to at least one of the first and second motors 62, 66. In some nonexclusive illustrative examples, power unit 34 may include a housing 86 within which capacitor 82 may be least partially disposed.

When a self-contained or modular power system according to the present disclosure, such as the capacitor-based modular power system 24 schematically presented in FIG. 2, is integrated with a suitable airframe 28 to form a toy aircraft, such as the toy aircraft 20 schematically presented in FIG. 1, the modular power system is then adapted to propel the toy aircraft 20. For example, as illustrated in the nonexclusive illustrative example presented in FIG. 2, capacitor 82 may be configured to provide and/or deliver power and/or current to at least one of the first and second motor units 58, 60. Delivery of power and/or current from capacitor 82 to at least one of the first and second motor units 58, 60 renders the at least one of the first and second motor units 58, 60 operable to propel a toy aircraft 20 on which the modular power system 24 is removably retained.

In some nonexclusive illustrative examples, the capacitor-based modular power system 24 may be configured to propel a toy aircraft 20 for flight durations of at least (approximately) 5, 10, 15, 20, 25, or even 30 or more seconds of powered flight. For example, the capacitor 82 may have a sufficiently high capacitance and/or voltage range such that capacitor 82 is capable of delivering and/or providing a suitable level of power and/or current to at least one of the first and second motor units 58, 60 for a desired duration. Nonexclusive illustrative examples of suitable types of capacitors may include super-capacitors, electrolytic double-layer capacitor, and/or polyacene capacitors. Nonexclusive illustrative examples of suitable capacitance and voltage range combinations may include eight (8) Farad, 2.7 volt capacitors; ten (10), 22 or even 56 Farad, 2.3 volt capacitors; and nine (9), 20 or even 50 Farad, 3.0 volt capacitors. A nonexclusive illustrative example of a suitable capacitor is the nine (9) Farad, 3.0 volt polyacene capacitor sold by the Shoei Electronics Co., Ltd. of Nagano, Japan as part no. PASLA0F905.

The first and second motor units 58, 60 may be connected to the power unit 34 with respective first and second pairs 88, 90 of electrical conducting members. As suggested in FIG. 2, the first and second pairs 88, 90 of electrical conducting members may electrically connect the respective first and second motors 62, 66 to the capacitor 82. In some nonexclusive illustrative examples, the first and second pairs 88, 90 of electrical conducting members may be flexible. For example, the first and second pairs 88, 90 of electrical conducting members may include pairs of flexible metal wires.

With regard to power system 24 it is within the scope of the present disclosure for the connections between the first and second motor units 58, 60 and the power unit 34 to be limited to flexible members when power system 24 is separated from airframe 28. For example, as shown in the nonexclusive illustrative example presented in FIG. 5, the connections between the first and second motor units 58, 60 and the power unit 34 may be limited to the first and second pairs 88, 90 of electrical conducting members. However, it should be understood that, even when the connections between the first and second motor units 58, 60 and the power unit 34 are limited to flexible members, power system 24 may include flexible connections other than the first and second pairs 88, 90 of electrical conducting members.

In some nonexclusive illustrative examples, the first and second pairs 88, 90 of electrical conducting members may be insulated. For example, the first and second pairs 88, 90 of electrical conducting members may include pairs of insulated wires. In some nonexclusive illustrative examples, the individual wires in each pair of insulated wires may be separate, such as where the two individual wires in each pair are twisted together. In some nonexclusive illustrative examples, the individual wires in each pair of insulated wires may be paired together, such as within a common sheath, conduit or other enclosing member.

Figure 3:
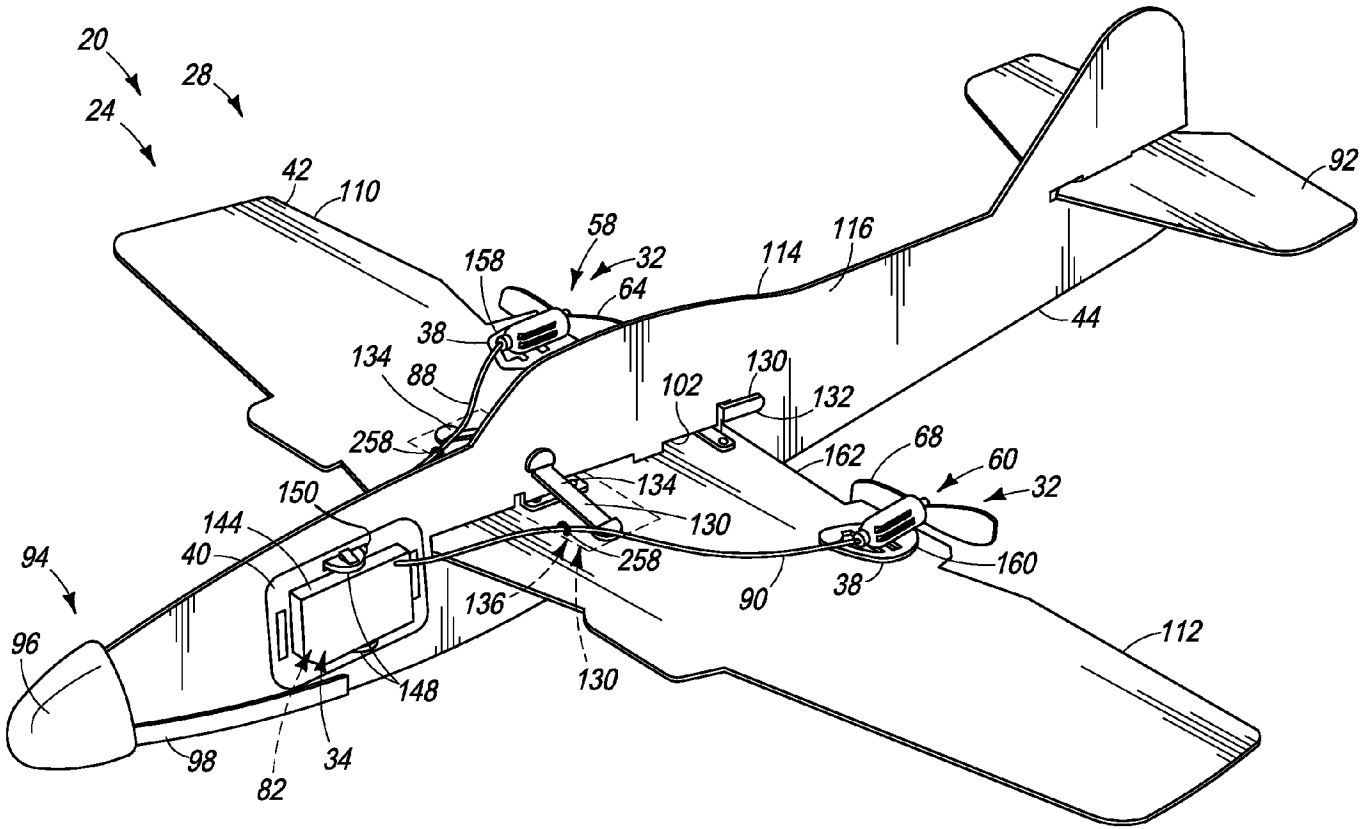
FIG. 3 is a perspective view of a modular toy aircraft incorporating a capacitor-based modular power system according to the present disclosure.
Figure 4:
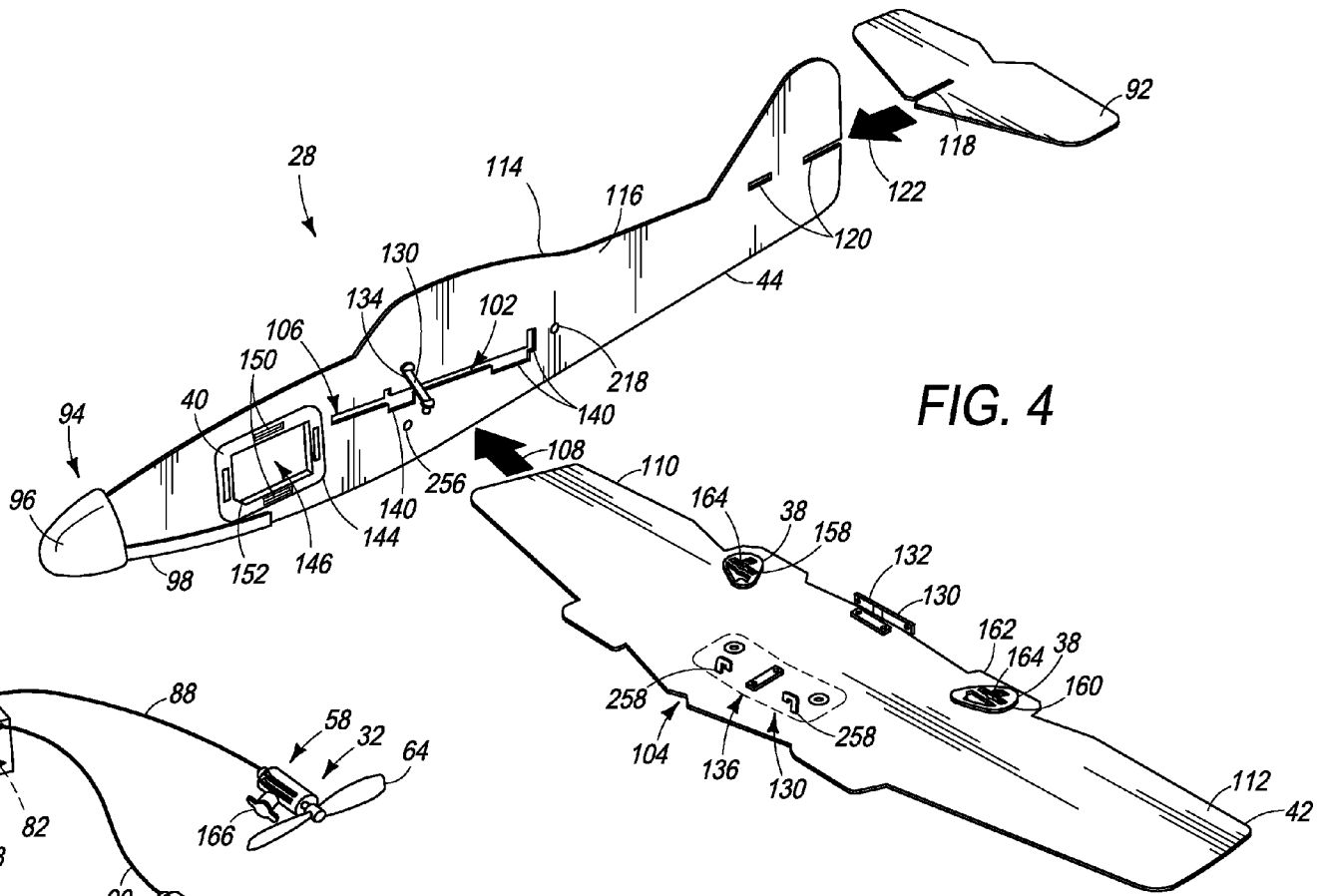
FIG. 4 is an exploded view of the airframe of the modular toy aircraft of FIG. 3.

Another nonexclusive illustrative example of a toy aircraft according to the present disclosure is shown in FIGS. 3 and 4 and indicated generally at 20. Unless otherwise specified, toy aircraft 20 may, but is not required to, contain at least one of the structure, components, functionality, and/or variations described, illustrated, and/or incorporated herein. As shown in the nonexclusive illustrative example presented in FIGS. 3 and 4, toy aircraft 20 may be configured as a modular toy aircraft that includes a capacitor-based power system 24, such as the nonexclusive illustrative example presented in FIG. 5, that is removably retained to an airframe 28.

As shown in the nonexclusive illustrative example presented in FIGS. 3 and 4, at least a portion of one or more of the airframe components, such as wing 42, fuselage 44, and horizontal stabilizer 92 (if present), may be fabricated from at least one flat panel of material. Suitable flat panels of material may include wood, cardboard, extruded polystyrene or other polymer-based panels. In some nonexclusive illustrative examples, some airframe components may be completely formed from a flat panel of material. For example, as shown in the nonexclusive illustrative example presented in FIGS. 3 and 4, airframe 28 may include a horizontal stabilizer 92 that is fabricated from a flat panel of material.

In some nonexclusive illustrative examples, at least a portion of at least one of the airframe components may be fabricated from an at least partially resilient material, such as an expanded polypropylene foam. For example, as shown in the nonexclusive illustrative example presented in FIGS. 3 and 4, a nose portion 94 of the fuselage 44 may be include a nose cone 96 having an increased thickness relative to the fuselage 44. In some nonexclusive illustrative examples, nose cone 96 may be fabricated from expanded polypropylene foam.

In some nonexclusive illustrative examples, one or more of the airframe components may include a protective element. Such a protective element may be configured to provide enhanced structural integrity and/or abrasion resistance to at least a portion of the airframe component on which it is disposed or affixed. For example, as shown in the nonexclusive illustrative example presented in FIGS. 3 and 4, the fuselage 44 may include at least one skid protector 98. Such a skid protector 98 may be fabricated from an injection molded plastic and secured to the fuselage 44 using a suitable method or mechanism, such as friction, adhesive, and/or one or more mechanical fasteners, such as pins extending at least partially through at least a portion of the fuselage 44.

In some nonexclusive illustrative examples where airframe 28 is assembled from components that are fabricated from flat panels of material, at least some of the airframe components may be at least partially frictionally retained relative to each other. For example, wing 42 and and/or horizontal stabilizer 92 may be at least partially frictionally retained relative to fuselage 44. As shown in the nonexclusive illustrative example presented in FIG. 4, fuselage 44 may include an aperture or slot 102 that is configured to at least partially frictionally receive the wing 42. The frictional engagement between the wing 42 and the slot 102 may be enhanced if one or more of the dimensions of slot 102 are slightly smaller than a corresponding dimension of wing 42. For example, the height of slot 102 may be slightly smaller than the thickness of wing 42. In some nonexclusive illustrative examples, wing 42 may include a structural feature, such as detent 104, that is configured to engage a corresponding portion of slot 102, such as the front end 106 of the slot. As shown in the nonexclusive illustrative example presented in FIG. 4, wing 42 may be connected to the fuselage 44 by inserting wing 42, as indicated by arrow 108, through slot 102 until first and second portions 110, 112 of the wing 42 extend from the respective first and second sides 114, 116 of the fuselage 44.

Where airframe 28 includes a horizontal stabilizer 92, the horizontal stabilizer 92 may be at least partially frictionally retained relative to the fuselage. For example, as shown in the non-exclusive example presented in FIG. 4, the horizontal stabilizer 92 may be connected to the fuselage 44 by engaging the corresponding slots 118 and 120 on the respective ones of the horizontal stabilizer 92 and the fuselage 44, as indicated by arrow 122. In some nonexclusive illustrative examples, the horizontal stabilizer 92 may be connected to the fuselage 44 by transversely inserting the horizontal stabilizer 92 through a slot in the fuselage 44, such as similar to the wing installation illustrated in FIG. 4. In some nonexclusive illustrative examples, the horizontal stabilizer 92 may be connected to the fuselage 44 by a combination of transverse insertion and longitudinal motion. For example, as illustrated in the nonexclusive example presented in FIG. 15, which will be more fully discussed below, the horizontal stabilizer 92 may be connected to the fuselage 44 by initially inserting the horizontal stabilizer 92 into a corresponding slot 124, as indicated by arrow 126, followed by rearward translation of the horizontal stabilizer 92 relative to the fuselage 44, as indicated by arrow 128.

In some nonexclusive illustrative examples, airframe 28 may include one or more structural elements or reinforcing members 130 configured to at least partially support the wing 42 relative to the fuselage 44. In some nonexclusive illustrative examples, at least one of the one or more reinforcing members 130 may be fabricated as an injection or otherwise molded plastic clip. Reinforcing members 130 may be configured to at least partially retain the wing 42 in a predetermined position relative to the fuselage 44. For example, as illustrated in the nonexclusive illustrative example presented in FIGS. 3 and 4, at least one reinforcing member 130 may be configured as a laterally-supporting wing clip 132, which will be more fully described below with respect to FIG. 6. Reinforcing members 130 may also and/or alternatively be configured to at least partially maintain the wing 42 in a predetermined orientation relative to the fuselage 44. For example, as illustrated in the nonexclusive illustrative example presented in FIGS. 3 and 4, at least one reinforcing member 130 may be configured wing strut 134. Reinforcing members 130 may also and/or alternatively be configured to at least partially induce a dihedral into the wing 42. By "dihedral," it is meant the upward angle of a wing, from the fuselage or wing root to the wing tip, from a line that is perpendicular to the fuselage. For example, as illustrated in the nonexclusive illustrative example presented in FIGS. 3 and 4, at least one reinforcing member 130 may be configured as a wing support clip 136, which will be more fully described below with respect to FIG. 7.

When airframe 28 includes one or more reinforcing members 130, the fuselage 44 and/or the wing 42 may be configured to provide clearance for the reinforcing members 130 during connection of the wing 42 to the fuselage 44. For example, as shown in the nonexclusive illustrative example presented in FIG. 4, slot 102 may include one or more enlarged regions 140 to clear the reinforcing members 130.

Figure 5:
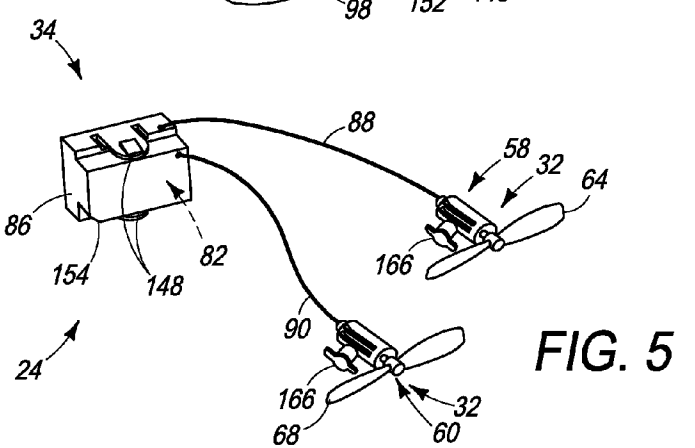
FIG. 5 is a perspective view of a capacitor-based modular power system suitable for use with toy aircraft, such as the modular toy aircraft and airframe of FIGS. 3 and 4.

Nonexclusive illustrative examples of suitable mounts for attaching a power system 24, such as the nonexclusive illustrative example presented in FIG. 5, to an airframe 28 are illustrated in FIGS. 3 and 4. Unless otherwise specified, the mounts for attaching power system 24 to an airframe 28, such as those illustrated in FIGS. 3 and 4, may, but are not required to, contain at least one of the structure, components, functionality, and/or variations described, illustrated, and/or incorporated herein.

As shown in the nonexclusive illustrative example presented in FIG. 4, the power unit mount 40 may be configured as a receptacle 144 disposed on the fuselage 44. The receptacle 144 may be configured to removably retain the power unit 34 relative to the airframe 28 and fuselage 44. For example, receptacle 144 may include an opening 146 that is configured to removably receive at least a portion of power unit 34, as shown in FIG. 3. The power unit 34 may include at least one barbed tab 148, as shown in FIG. 5, that is configured to engage a corresponding opening 150 on receptacle 144, as shown in FIG. 4, such that power unit 34 is retained by the receptacle 144, as shown in FIG. 3. In some nonexclusive illustrative examples, opening 146 may be configured to nondestructively removably receive at least a portion of power unit 34. By "nondestructively," it is meant that the nondestructively engaged elements are not damaged during nondestructive engagement or disengagement.

In some nonexclusive illustrative examples, the opening 146 of power unit mount 40 may be configured to receive the housing 86 of the power unit 34 in a predetermined orientation. As such, opening 146 and housing 86 may include one or more asymmetric features such that housing 86 may be received in opening 146 in a predetermined orientation, such as with a particular end of housing 86 oriented towards the nose portion 94 of the fuselage 44. For example, at least one corner of opening 146 may be angled in correspondence with at least one corner of housing 86 such that opening 146 is configured to receive housing 86 in a limited number of orientations. As shown in the nonexclusive illustrative example presented in FIGS. 4 and 5, a single corner 152 of opening 146 may be angled in correspondence with a single corner 154 of housing 86 such that opening 146 is configured to receive housing 86 in a single predetermined orientation.

As shown in the nonexclusive illustrative example presented in FIG. 4, the propulsion unit mounts 38 may be configured as first and second motor unit mounts 158, 160. The first and second motor unit mounts 158, 160 may be disposed on the respective first and second portions 110, 112 of wing 42, such as proximate the trailing edge 162 of wing 42. Each of the first and second motor unit mounts 158, 160 may be configured to removably receive and retain one of the first and second motor units 58, 60. In some nonexclusive illustrative examples, the first and second motor unit mounts 158, 160 may be configured to nondestructively removably receive and retain the first and second motor units 58, 60. For example, each of the first and second motor unit mounts 158, 160 may include a receptacle, such as an aperture 164, as shown in FIG. 4, that is configured to receive a portion of one of the first and second motor units 58, 60, such as a mounting foot 166, as shown in FIG. 5. The details of the engagement between the first and second motor units 58, 60 and the first and second motor unit mounts 158, 160 will be more fully discussed below with respect to FIGS. 8-13.

Figure 6:
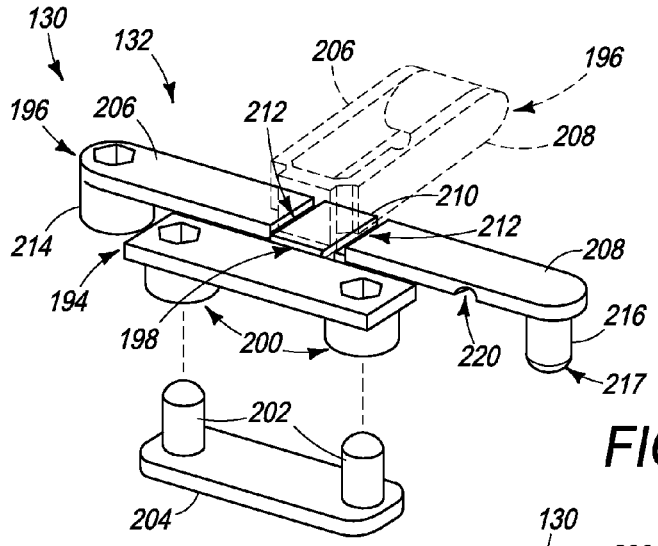
FIG. 6 is a detail view of a nonexclusive illustrative example of a laterally-supporting wing clip suitable for use with toy aircraft, such as the modular toy aircraft and airframe of FIGS. 3 and 4.

A nonexclusive illustrative example of a laterally-supporting wing clip 132 is illustrated in FIG. 6. Unless otherwise specified, the laterally-supporting wing clip 132, may, but is not required to, contain at least one of the structure, components, functionality, and/or variations described, illustrated, and/or incorporated herein. Clip 132, which may be fabricated from a molded plastic, includes a first or wing engaging portion 194 and a second or fuselage engaging portion 196. As shown in the nonexclusive illustrative example presented in FIG. 6, the wing engaging portion 194 may be connected to the fuselage engaging portion 196 by a region of reduced thickness 198. Such a region of reduced thickness 198 forms a living hinge, which enables the fuselage engaging portion 196 to be bent, such as out of plane, relative to the wing engaging portion 194, as suggested in dashed lines in FIG. 6.

As shown in the nonexclusive illustrative example presented in FIG. 6, the wing engaging portion 194 of clip 132 may include at least one socket 200 that is configured to extend through a corresponding hole in a wing 42, as suggested in FIGS. 3 and 4. Each of the at least one sockets 200 may be configured to frictionally and/or mechanically engage a corresponding pin 202 on a backing clip 204. When wing engaging portion 194 and backing clip 204 are engaged through corresponding holes in wing 42, as suggested in FIGS. 3 and 4, clip 132 is retained relative to wing 42.

As shown in the nonexclusive illustrative example presented in FIG. 6, the fuselage engaging portion 196 of clip 132 may include first and second arms 206, 208. The first and second arms 206, 208 may be connected to a central portion 210 of the fuselage engaging portion 196 by regions of reduced thickness 212, which may provide living hinges that enable bending of the first and second arms 206, 208 relative to the central portion 210, as suggested in dashed lines in FIG. 6. As shown in the nonexclusive illustrative example presented in FIG. 6, respective ones of the first and second arms 206, 208 may include a socket 214 and a corresponding pin 216, which is configured for frictional and/or mechanical engagement with socket 214. Mechanical engagement between pin 216 and socket 214 may occur where at least a portion of pin 216, such as an end portion 217, has at least one larger radial dimension than socket 214. When the socket 214 and pin 216 of the first and second arms 206, 208 are brought into frictional and/or mechanical engagement through an appropriate hole in fuselage 44, such as the hole 218 illustrated in FIG. 4, clip 132 is retained relative to fuselage 44, as shown in FIG. 3. In some nonexclusive illustrative examples one or more of the first and second arms 206, 208 may include a region of reduced thickness 220, which may at least partially facilitate engagement of pin 216 with socket 214.

Figure 7:
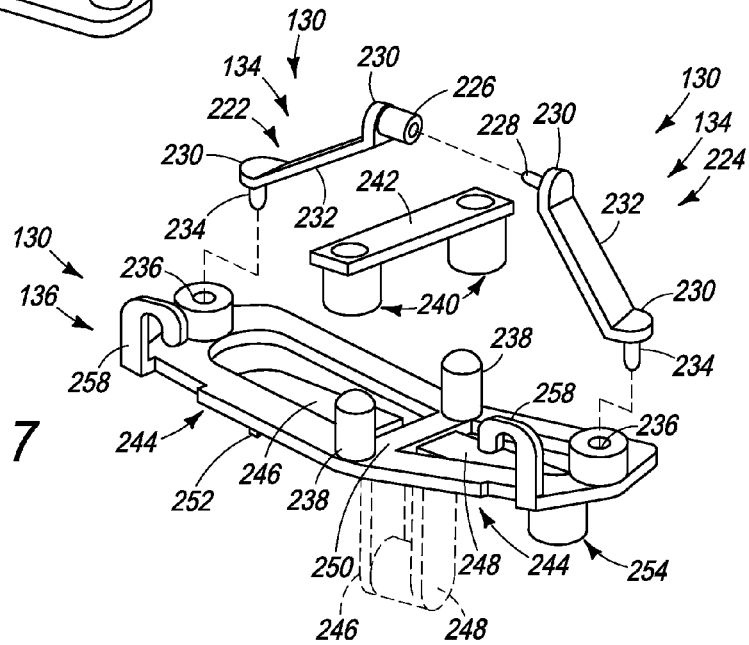
FIG. 7 is a detail view of a nonexclusive illustrative example of a wing support clip and struts suitable for use with toy aircraft, such as the modular toy aircraft and airframe of FIGS. 3 and 4.

Nonexclusive illustrative examples of wing struts 134 and a wing support clip 136 are presented in FIG. 7. Unless otherwise specified, wing struts 134 and wing support clip 136, may, but are not required to, contain at least one of the structure, components, functionality, and/or variations described, illustrated, and/or incorporated herein.

Wing struts 134 may be configured as a first wing strut 222 or a second wing strut 224, as suggested in the nonexclusive illustrative examples presented in FIG. 7. The first wing strut 222 may include a socket 226 and second wing strut 224 may include a pin 228, where socket 226 is configured to frictionally and/or mechanically engage and retain pin 228. When the first and second wing struts 222, 224 are engaged though a corresponding hole in the fuselage 44, as suggested in FIGS. 3 and 4, the first and second wing struts 222, 224 are retained relative to fuselage 44. In some nonexclusive examples, the end regions 230 of struts 134 may be flexibly connected to the central portion 232 of the strut, such as by regions of reduced thickness, which may form at least one living hinge. Each of the first and second wing struts 222, 224 may include a pin 234 that is configured to engage a corresponding socket 236 on the wing support clip 136.

As shown in the nonexclusive illustrative example presented in FIG. 7, wing support clip 136 may include at least one pin 238 that is configured to extend through a corresponding hole in a wing 42, as suggested in FIGS. 3 and 4. Each of the at least one pins 238 may be configured to frictionally and/or mechanically engage a corresponding socket 240 on a backing clip 242. When wing support clip 136 and backing clip 242 are engaged through corresponding holes in wing 42, as suggested in FIGS. 3 and 4, wing support clip 136 is retained relative to wing 42. In some nonexclusive illustrative examples, such as for the wing support clip 136 shown in FIG. 7, the outer portions 244 of the wing support clip 136 may be angled relative to each other, rather than being coplanar. Thus, if such a wing support clip 136 is secured to the lower surface of a wing, as shown in the nonexclusive illustrative example, presented in FIGS. 3 and 4 (with sockets 236 and pins 238 extending through the wing), a dihedral angle will be induced into the wing. Conversely, if such a wing support clip 136 is secured to the upper surface of a wing (with sockets 236 and pins 238 extending through the wing), an anhedral angle will be induced into the wing.

As shown in the nonexclusive illustrative example presented in FIG. 7, wing support clip 136 may include first and second arms 246, 248. The first and second arms 246, 248 may be connected to a central portion 250 of wing support clip 136 by regions of reduced thickness, which may provide living hinges that enable bending of the first and second arms 246, 248 relative to the central portion 250, as suggested in dashed lines in FIG. 7. As shown in the nonexclusive illustrative example presented in FIG. 7, respective ones of the first and second arms 246, 248 may include a pin 252 and a corresponding socket 254, which is configured for frictional and/or mechanical engagement with pin 252. When the pin 252 and corresponding socket 254 of the first and second arms 246, 248 are brought into frictional and/or mechanical engagement through an appropriate hole in fuselage 44, such as the hole 256 illustrated in FIG. 4, wing support clip 136 is retained relative to fuselage 44.

In some nonexclusive illustrative examples, the airframe 28 may be configured to at least partially retain and/or restrain at least one of the first and second pairs of electrical conducting members 88, 90 relative to the airframe. For example, one or more retention devices, such as hooks 258, may be provided on wing 42, such that the first and second pairs of electrical conducting members 88, 90 may be at least partially retained and/or restrained relative to the wing 42, as illustrated in FIGS. 3 and 4. In some nonexclusive illustrative examples, the hooks 258 may be incorporated into the wing support clip 136, as shown in FIG. 7.

Figure 11:
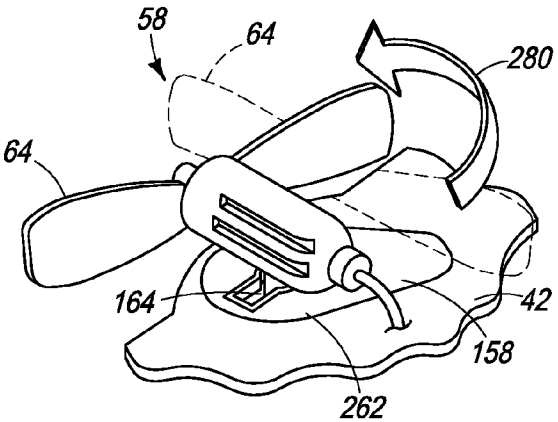
FIG. 11 is a motor side perspective view illustrating the first motor unit of FIG. 8 rotated into an operative position.
Figure 12:
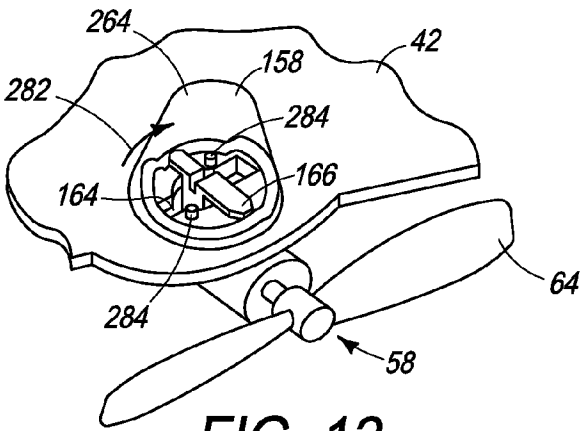
FIG. 12 is a rear side perspective view illustrating the first motor unit of FIG. 8 rotated into the operative position illustrated in FIG. 11.
Figure 13:
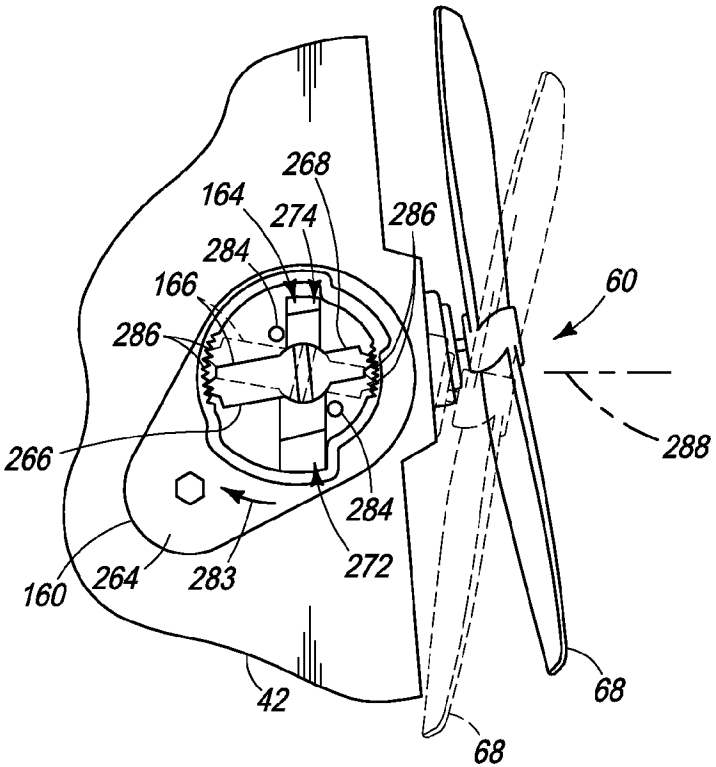
FIG. 13 is a rear side view of a second motor unit, which corresponds to the first motor unit of FIG. 8, rotated into one of a plurality of operative orientations relative to a second motor unit mount.

Nonexclusive illustrative examples of first and second motor units 58, 60, such as the first and second motor units 58, 60 of the nonexclusive illustrative example of a power system 24 shown in FIG. 5, being mounted to, or mounted to, first and second motor unit mounts 158, 160 are presented FIGS. 8-13. In particular, a nonexclusive illustrative example of mounting a first motor unit 58 to a first motor unit mount 158 is shown in FIGS. 8-12, and a nonexclusive illustrative example of a second motor unit 60 mounted to a second motor unit mount 160 is shown in FIG. 13. Unless otherwise specified, first motor unit 58, first motor unit mount 158, second motor unit 60 and second motor unit mount 160 may, but are not required to, contain at least one of the structure, components, functionality, and/or variations described, illustrated, and/or incorporated herein. As shown or suggested in the nonexclusive illustrative examples presented in FIGS. 8-13, each of the first and second motor units 58, 60 may include a mounting foot 166 and each of the first and second motor unit mounts 158, 160 may include an aperture 164 that extends from a first or motor side 262 to a second or rear side 264. The apertures 164 on the first and second motor unit mounts 158, 160 may be configured to receive the mounting foot 166 of a corresponding one of the first and second motor units 58, 60.

The first or motor side 262 and the second or rear side 264 of the first and second motor unit mounts 158, 160 should not be understood to refer to a particular side of the wing 42. Rather, the first or motor side 262 refers to the side of the motor unit mount on which the motor of the motor unit resides when the motor unit is received by the motor unit mount, as will be more fully discussed below. The second or rear side 264 refers to the side of the motor unit mount that is opposite to the first or motor side 262. The first or motor side 262 of at least one motor unit mount may be on an upper surface of wing 42, as illustrated in the nonexclusive illustrative example presented in FIG. 3, or the first or motor side 262 of at least one motor unit mount may be on a lower surface of wing 42, as illustrated in the nonexclusive illustrative example presented in FIG. 14.

In some nonexclusive illustrative examples, the motor unit mounts may be configured to removably receive a corresponding one of the motor units in at least one predetermined orientation relative to the wing 42. When a motor unit is in a predetermined or operative orientation, the propeller may be configured and/or oriented such that the propeller at least partially generates forward thrust for toy aircraft 20, as suggested in FIGS. 3 and 14. For example, as shown in the nonexclusive illustrative examples presented in FIGS. 8-13, the first and second motor unit mounts 158, 160 may be configured to removably receive the respective ones of the first and second motor units 58, 60 in at least one predetermined orientation relative to the wing 42.

As shown in the nonexclusive illustrative examples presented in FIGS. 8-13 the apertures 164 on the first and second motor unit mounts 158, 160 and the mounting feet 166 of the first and second motor units 58, 60 may include one or more asymmetries. Such asymmetries may at least partially limit and/or restrict the possible orientations with which a motor unit mount may receive a motor unit. For example, as shown in the nonexclusive illustrative examples presented in FIGS. 8-13, the mounting foot 166 may include a larger or first end 266 that is relatively wider than a smaller or second end 268. The aperture 164 may correspondingly include a first or larger end 272 to accommodate the first end 266 of the mounting foot 166 and a second or smaller end 274 to accommodate the second end 268 of the mounting foot 166. In some nonexclusive illustrative examples, the respective mounting feet 166 of the first and second motor units 58, 60 may differ. For example, as shown in the nonexclusive illustrative example presented in FIG. 8, the larger or first end 266 of the mounting foot 166 of the first motor unit 58 may be disposed proximate the propeller 64, while the smaller or second end 268 of the mounting foot 166 of the second motor unit 60 may be disposed proximate the propeller 68, as shown in the nonexclusive illustrative example presented in FIG. 13.

Figure 8:
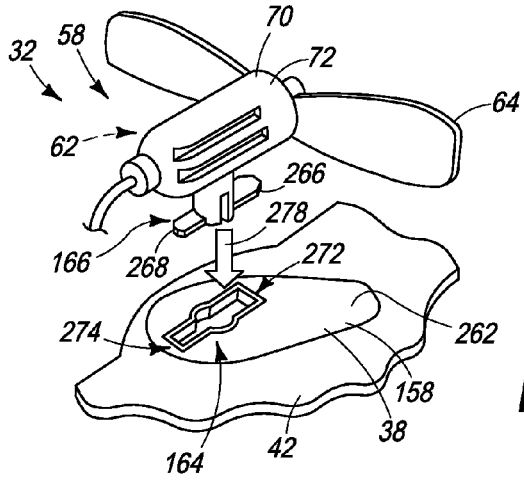
FIG. 8 is a motor side perspective view illustrating installation of a nonexclusive illustrative example of a first motor unit into a nonexclusive illustrative example of a first motor unit mount on the wing of a toy aircraft, such as the modular toy aircraft and airframe of FIGS. 3 and 4.
Figure 9:
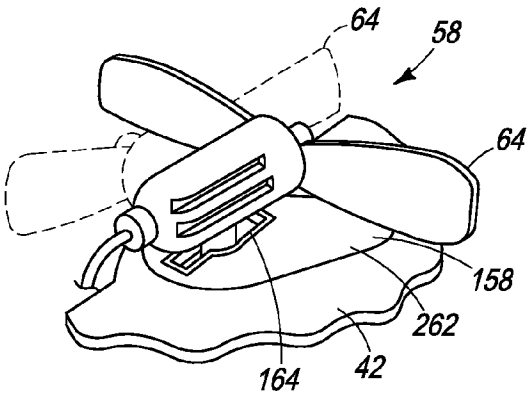
FIG. 9 is a motor side perspective view illustrating the first motor unit of FIG. 8 in a partially installed position.

To engage the first motor unit 58 with the first motor unit mount 158, the first motor unit 58 is positioned over the motor side 262 of aperture 164, as illustrated in FIG. 8, with the first motor unit 58 oriented such that the first and second ends 266, 268 of the mounting foot 166 are aligned with respective ones of the first and second ends 272, 274 of aperture 164. The mounting foot 166 is inserted into the aperture 164, as indicated by arrow 278. When the mounting foot 166 is sufficiently inserted into aperture 164, as shown in FIG. 9, the mounting foot 166 protrudes beyond the rear side 264 of aperture 164, a shown in FIG. 10. Once sufficiently inserted into aperture 164, the first motor unit 58 is rotated relative to the first motor unit mount 158, as indicated by arrow 280 in FIG. 11 (counterclockwise when viewed looking towards the motor side 262) and arrow 282 in FIG. 12 (clockwise when viewed looking towards the rear side 264), until the motor unit 58 is aligned and/or configured to at least partially generate forward thrust. Although the nonexclusive illustrative example presented in FIGS. 8-12 includes rotation in one or more particular directions, it should be understood that other examples may include rotation in an opposite direction and/or other forms of movement such as linear translations. In some nonexclusive illustrative examples, motor unit 58 is aligned and/or configured to at least partially generate forward thrust when the propeller 64 may rotate without impacting the wing 42, as shown in FIGS. 11 and 12.

The second motor unit 60 may be engaged with the second motor unit mount 160 following a similar procedure to that discussed above with respect to the first motor unit 58 and first motor unit mount 158. As suggested in FIG. 13, the second motor unit 60 is oriented such that the first and second ends 266, 268 of the mounting foot 166 are aligned with respective ones of the first and second ends 272, 274 of aperture 164. The mounting foot 166 is inserted into the aperture 164 until the mounting foot 166 protrudes beyond the rear side 264 of aperture 164, and the second motor unit 60 is rotated relative to the second motor unit mount 160, as indicated by arrow 283 in FIG. 13 (clockwise when viewed looking towards the rear side 264), until the motor unit 60 is aligned and/or configured to at least partially generate forward thrust. Although the nonexclusive illustrative example presented in FIG. 13 includes rotation in one or more particular directions, it should be understood that other examples may include rotation in an opposite direction and/or other forms of movement such as linear translations. In some nonexclusive illustrative examples, motor unit 60 is aligned and/or configured to at least partially generate forward thrust when the propeller 68 may rotate without impacting the wing 42, as shown in FIG. 13.

Figure 10:
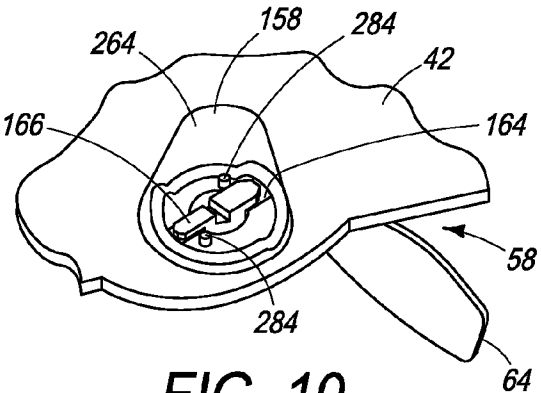
FIG. 10 is a rear side perspective view illustrating the first motor unit of FIG. 8 in the partially installed position illustrated in FIG. 9.

In some nonexclusive illustrative examples, at least one of the first and second motor unit mounts 158, 160 may include one or more rotation restricting devices that may at least partially limit the rotation of the mounting foot 166 relative to the motor unit mount. For example, the first and second motor unit mounts 158, 160 may include one or more projections or studs 284, as shown in FIGS. 10, 12 and 13. Such rotation restricting devices may be configured to at least partially deter and/or preclude undesired rotation of the motor unit. For example, as shown in the nonexclusive illustrative example presented in FIGS. 10 and 12, the studs 284 on the first motor unit mount 158 are configured to at least partially prevent rotation of the first motor unit 58 in a direction opposite to that indicated by arrows 280 and 282 and/or rotation of the first motor unit 58 beyond a certain point in the direction indicated by arrows 280 and 282. Such restrictions on rotation of the first motor unit 58 may at least partially preclude the first motor unit mount 158 from receiving and/or retaining the first motor unit 58 in a position and/or orientation in which the first motor unit 58 is rendered inoperative, such as where the wing 42 precludes rotation of the propeller 64. As shown in the nonexclusive illustrative example presented in FIG. 13, the studs 284 on the second motor unit mount 160 are configured to prevent rotation of the second motor unit 60 in a direction opposite to that indicated by arrow 283 and/or rotation of the second motor unit 60 beyond a certain point in the direction indicated by arrow 283. Such restrictions on rotation of the second motor unit 60 may at least partially preclude the second motor unit mount 160 from receiving and/or retaining the second motor unit 60 in a position and/or orientation in which the second motor unit 60 is rendered inoperative, such as where the wing 42 precludes rotation of the propeller 68.

In some nonexclusive illustrative examples, the first motor unit mount 158 may be configured to preclude receiving the second motor unit 60 in a position and/or orientation in which the second motor unit 60 at least partially generates forward thrust and/or the second motor unit mount 160 may be configured to preclude receiving the first motor unit 58 in a position and/or orientation in which the first motor unit 58 at least partially generates forward thrust. For example, as may be observed from comparison of the nonexclusive illustrative examples of the second motor unit 60 and the first motor unit mount 158 presented in FIGS. 8-13, the configuration of the aperture 164 and studs 284 of the first motor unit mount 158 in combination with the orientation of the first and second ends 266, 268 of the mounting foot 166 of the second motor unit 60 may at least partially preclude the first motor unit mount 158 from receiving the second motor unit 60 in a position and/or orientation in which propeller 68 may rotate without impacting the wing 42. As may be observed from comparison of the nonexclusive illustrative examples of the first motor unit 58 and the second motor unit mount 160 that are presented in FIGS. 8-13, the configuration of the aperture 164 and studs 284 of the second motor unit mount 160 in combination with the orientation of the first and second ends 266, 268 of the mounting foot 166 of the first motor unit 58 may at least partially preclude the second motor unit mount 160 from receiving the first motor unit 58 in a position and/or orientation in which the propeller 64 may rotate without impacting the wing 42.

In some nonexclusive illustrative examples, the first motor unit mount 158 may be configured to preclude receiving the second motor unit 60 and/or the second motor unit mount 160 may be configured to preclude receiving the first motor unit 58. For example, the aperture 164 of the first motor unit mount 158 may be configured to preclude receiving the mounting foot 166 of the second motor unit 60 and/or the aperture 164 of the second motor unit mount 160 may be configured to preclude receiving the mounting foot 166 of the first motor unit 58.

In some nonexclusive illustrative examples, the first motor unit mount 158 may be configured to render the second motor unit 60 inoperative if the second motor unit 60 is received by the first motor unit mount 158 and/or the second motor unit mount 160 may be configured to render the first motor unit 58 inoperative if the first motor unit 58 is received by the second motor unit mount 160. For example, the first and second motor units 58, 60 and/or the first and second motor unit mounts 158, 160 may include electrical and/or mechanical interlocks and/or disconnects configured to interrupt or otherwise disable and/or prevent the provision and/or delivery of power and/or current to the first motor unit 58 when the first motor unit 58 is received by the second motor unit mount 160 and/or to the second motor unit 60 when the second motor unit 60 is received by the first motor unit mount 158.

In some nonexclusive illustrative examples, at least one of the first and second motor unit mounts 158, 160 may be configured to retain the respective one of the first and second motor units 58, 60 in a selected one of a plurality of predetermined orientations. For example, at least one of the first and second motor unit mounts 158, 160 may be configured to retain the respective one of the first and second motor units 58, 60 in a selected one of a plurality of rotational orientations relative to the wing 42 in which the respective one of the first and second propellers 64, 68 at least partially generates forward thrust for toy aircraft 20. As shown in the nonexclusive illustrative example presented in FIG. 13, at least one of the first and second motor unit mounts 158, 160, such as the second motor unit mount 160, may include a plurality of protrusions or teeth 286 that are configured to engage at least one of the first and second ends 266, 268 of mounting foot 166. Such mounting teeth 286 may provide a plurality of predetermined orientations for the motor unit. A nonexclusive illustrative example of a first predetermined orientation of a motor unit is illustrated in solid lines in FIG. 13, and a nonexclusive illustrative example of another predetermined orientation of the motor unit is illustrated in dashed lines in FIG. 13. Although illustrated as a plurality of engagable teeth in the nonexclusive illustrative example presented in FIG. 13, any periodic and/or intermittent series of mechanical detents may be used, such as at least partially overlapping and/or engaged rounded elements.

The plurality of predetermined orientations in which a first or second motor unit 58, 60 may be retained by a corresponding one of the first and second motor unit mounts 158, 160 may range over any suitable angle such as 5 degrees, 10 degrees, 15 degrees, 20 degrees, 30 degrees, or even 45 or more degrees. In some nonexclusive illustrative examples, the angular range of the plurality of predetermined orientations may be symmetric about a plane or axis 288 that is parallel to the fuselage 44. In some nonexclusive illustrative examples, the angular range of the plurality of predetermined orientations may permit relatively greater outward or inward rotation relative to axis 288. For example, where the edge, either forward or rearward, of the wing 42 that is proximate the motor unit mount is swept, either forward or rearward, the angular range of the plurality of predetermined orientations may be selected to exclude orientations in which the propeller would impact the wing 42.

Permitting oblique orientation and/or alignment of at least one of the first and second motor units 58, 60 relative to the wing 42 and/or the fuselage 44 may permit trimming the flight of the toy aircraft 20 based on the corresponding obliquely oriented and/or aligned thrust vector or vectors from the propeller driven by the obliquely oriented motor unit or units. For example, at least one of the first and second motor units 58, 60 may be selectively angled and/or oriented such that the toy aircraft 20 tends to fly straight and/or such that the toy aircraft 20 tends to turn during flight. In some nonexclusive illustrative examples, the effect of the angling of the first and second motor units 58, 60 may vary with the speed and/or attitude of the aircraft. In some nonexclusive illustrative examples, selectively angling and/or orienting at least one of the first and second motor units 58, 60 may permit trimming the flight characteristics of the aircraft, such as to compensate for differing thrust outputs of the left and right motors and/or other conditions that tend to affect flight. For example, the toy aircraft 20 may be trimmed for a desired flight path, such as straight flight, by selectively angling and/or orienting at least one of the first and second motor units 58, 60 to compensate for such conditions as one or more bent portions of airframe 28, such as the wing 42 or the fuselage 44, that induces a left and/or right turning tendency into the toy aircraft 20. In some nonexclusive illustrative examples, selectively angling and/or orienting at least one of the first and second motor units 58, 60 may permit and/or cause the toy aircraft 20 to perform a maneuver, such as a loop, roll, spin, circle, or the like, absent any control input during flight. Further, by selectively angling and/or orienting at least one of the first and second motor units 58, 60 to a greater or lesser extent, the radius of the loop, roll, spin, circle or other maneuver may be selected.

Figure 14:
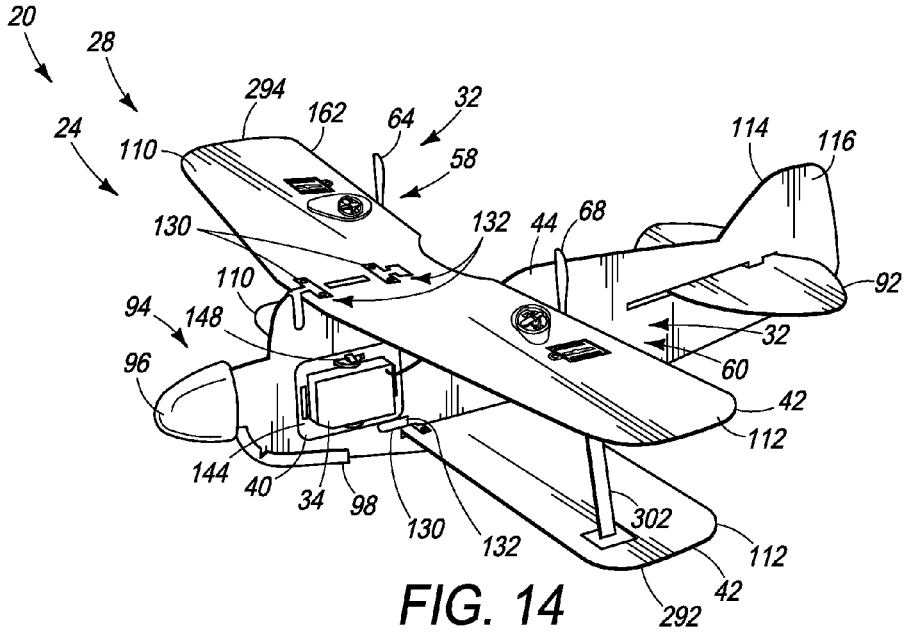
FIG. 14 is a perspective view of another embodiment of a modular toy aircraft incorporating a capacitor-based modular power system according to the present disclosure.
Figure 15:
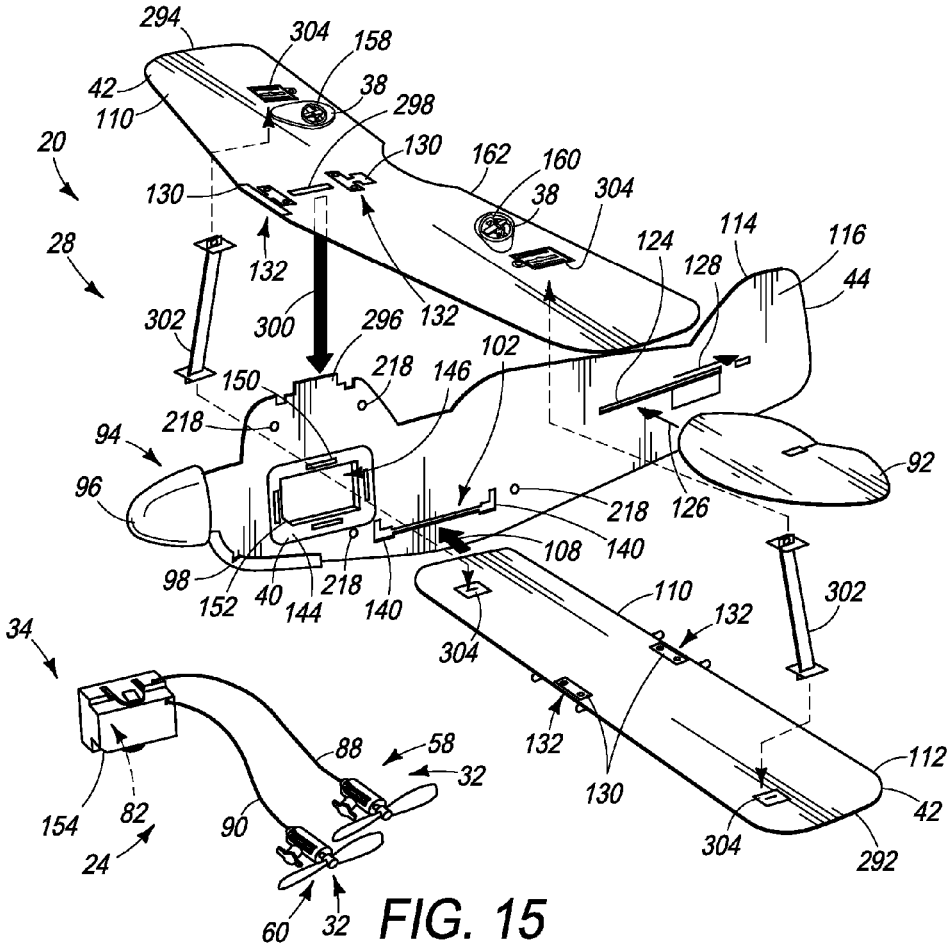
FIG. 15 is an exploded view of the modular toy aircraft and capacitor-based modular power system of FIG. 14.

Another nonexclusive illustrative example of a toy aircraft according to the present disclosure is shown in FIGS. 14 and 15 and indicated generally at 20. Unless otherwise specified, toy aircraft 20 may, but is not required to, contain at least one of the structure, components, functionality, and/or variations described, illustrated, and/or incorporated herein.

As shown in the nonexclusive illustrative example presented in FIGS. 14 and 15, toy aircraft 20 may include first and second wings 292, 294. The first and second wings 292, 294 may be arranged in any suitable manner relative to the airframe 28 and/or fuselage 44, such as in tandem where one of the first and second wings 292, 294 is forward of the other of the first and second wings 292, 294, or in a biplane configuration, as shown in the nonexclusive illustrative example presented in FIGS. 14 and 15.

In some nonexclusive illustrative examples, at least one of the first and second wings 292, 294, such as the first wing 292, may generally be attached to the airframe 28 and/or fuselage 44 as generally described above and illustrated in FIG. 15. In some nonexclusive illustrative examples, the second wing 294 may be attached to the airframe 28 and/or fuselage 44 in a manner similar to that for the first wing 292, or it may be installed differently. For example, as shown in the nonexclusive illustrative example presented in FIG. 15, the second wing 294 may be attached to the airframe 28 and/or fuselage 44 by inserting a portion 296 of the fuselage 44 into a slot 298 in wing 294, as indicated by arrow 300. In some nonexclusive illustrative examples, at least one of the first and second wings 292, 294 may be at least partially supported relative to the fuselage 44 by one or more structural elements or reinforcing members 130, such as the laterally-supporting wing clips 132 shown in FIGS. 14 and 15.

Figure 16:
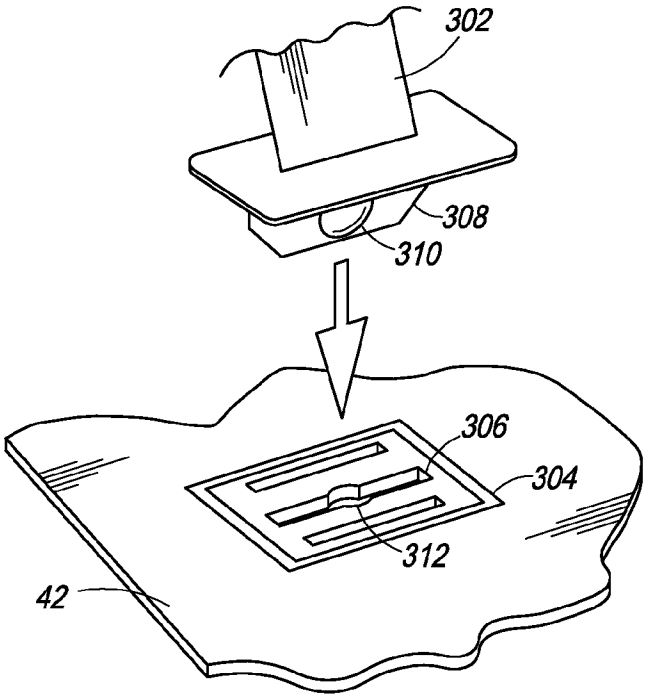
FIG. 16 is a detail view illustrating the connection between a wing strut and a wing of the modular toy aircraft of FIGS. 14-15.

As shown in the nonexclusive illustrative example presented in FIGS. 14 and 15, the first and second wings 292, 294 may additionally or alternatively be at least partially supported relative to each other and/or relative to the airframe 28 and/or the fuselage 44 by one or more struts 302. The struts 302, which may be uniform or configured into one or more pairs of left and right struts, may engage corresponding sockets 304 on the first and second wings 292, 294, as shown in FIG. 15. As shown in the nonexclusive illustrative example presented in FIG. 16, the sockets 304 may include an aperture 306 that is configured to receive an end 308 of a strut 302. In some nonexclusive illustrative examples, strut 302 may be at least partially retained by an enlarged portion 310 of end 308 that engages a corresponding portion 312 of aperture 306.

Figure 17:
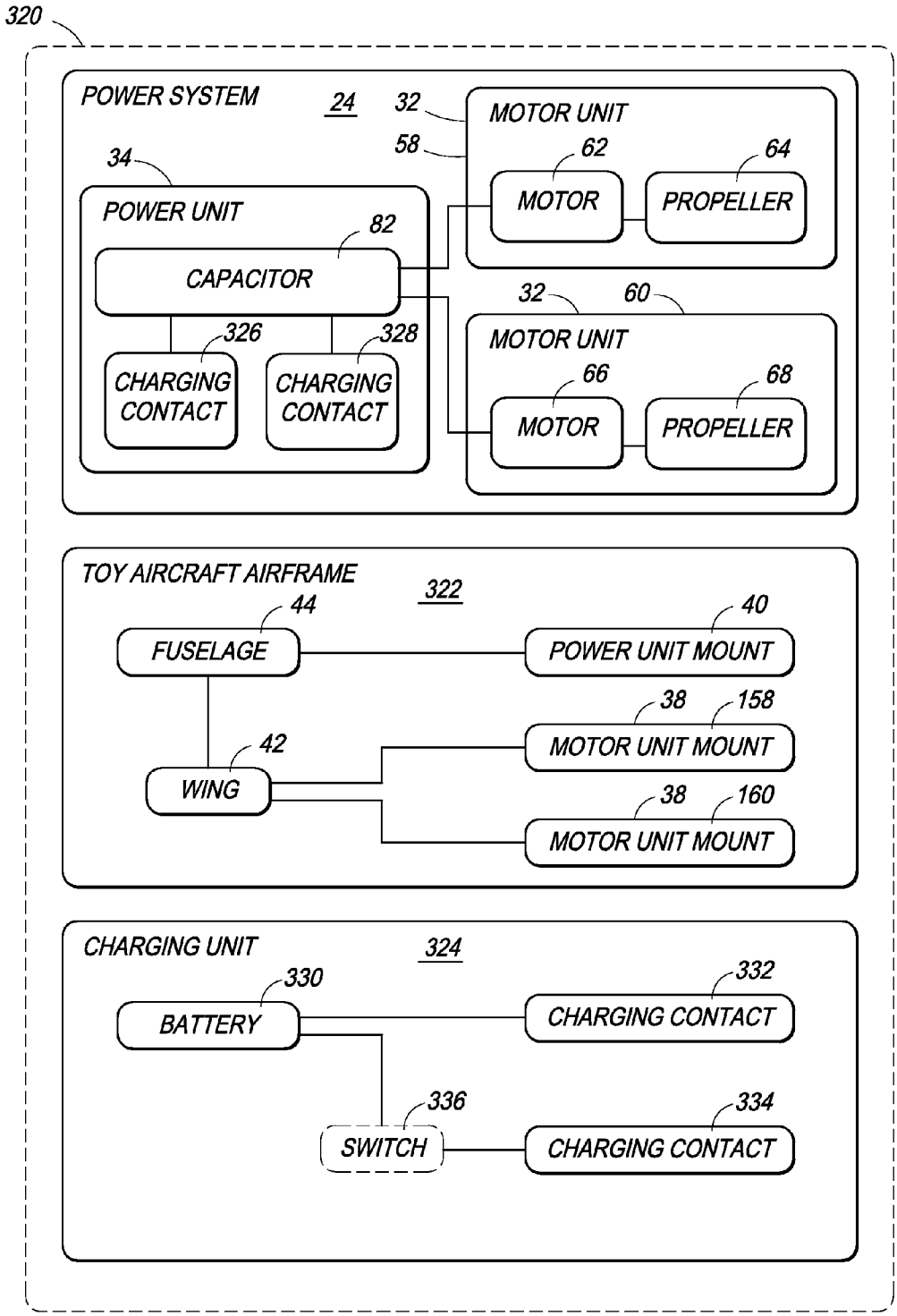
FIG. 17 is a block diagram of a toy aircraft kit according to the present disclosure, including a capacitor-based modular power system, a toy aircraft airframe and a charging unit.

A nonexclusive illustrative example of a toy aircraft kit 320 according to the present disclosure is shown schematically in FIG. 17. Unless otherwise specified, the toy aircraft kit 320 and any of its component parts may, but are not required to, contain at least one of the structure, components, functionality, and/or variations described, illustrated, and/or incorporated herein. The toy aircraft kit 320 may include a capacitor-based modular power system 24, a toy aircraft airframe 322 and a charging unit 324.

The modular power system 24 may include a power unit 34, a first motor unit 58, and a second motor unit 60. The power unit 34 may include a capacitor 82 and first and second charging contacts 326, 328, which may be connected to respective ones of the first and second leads of the capacitor 82. The first motor unit 58 may include a first motor 62, which may be electrically connected to the first and second leads of the capacitor 82, and a first propeller 64. The second motor unit 60 may include a second motor 66, which may be electrically connected to the first and second leads of the capacitor 82, and a second propeller 68.

The toy aircraft airframe 322 may include a fuselage 44, at least one wing 42, first and second motor unit mounts 158, 160, and a power unit mount 40. The wing 42 may be configured to extend from the fuselage 44. The first and second motor unit mounts 158, 160 may be disposed on the wing 42, and may be configured to removably retain respective ones of the first and second motor units 58, 60. The power unit mount 40 may be disposed on the fuselage 44, and may be configured to removably retain the power unit 34.

In some nonexclusive illustrative examples, the toy aircraft airframe 322, as included in the kit 320, may be at least partially unassembled and/or at least partially disassembled. For example, the wing 42 may be included in kit 320 while disassembled from the fuselage 44.

The charging unit 324 may include at least one battery 330 and first and second charging contacts 332, 334. The first and second charging contacts 332, 334 may be electrically connected to the positive and negative terminals of the battery 330. The battery 330 may be rechargeable and/or replaceable and may include at least one cell. In some nonexclusive illustrative examples, the charger unit 324 may include at least one switch 336 interposed between at least one of the first and second charging contacts 332, 334 and a corresponding terminal of the battery 330. The switch 336 may be configured to enable and/or interrupt the flow of current between the battery 330 and the first and second charging contacts 332, 334. In some nonexclusive illustrative examples, the switch 336 may be a momentary switch such that the switch 336 must be actively held to enable and/or interrupt the flow of current between the battery 330 and the first and second charging contacts 332, 334. In some nonexclusive illustrative examples, the switch 336 may be a push-on/push-off switch such that, once the switch 336 is activated, the flow of current between the battery 330 and the first and second charging contacts 332, 334 is enabled and/or interrupted until the switch 336 is deactivated.

Figure 18:
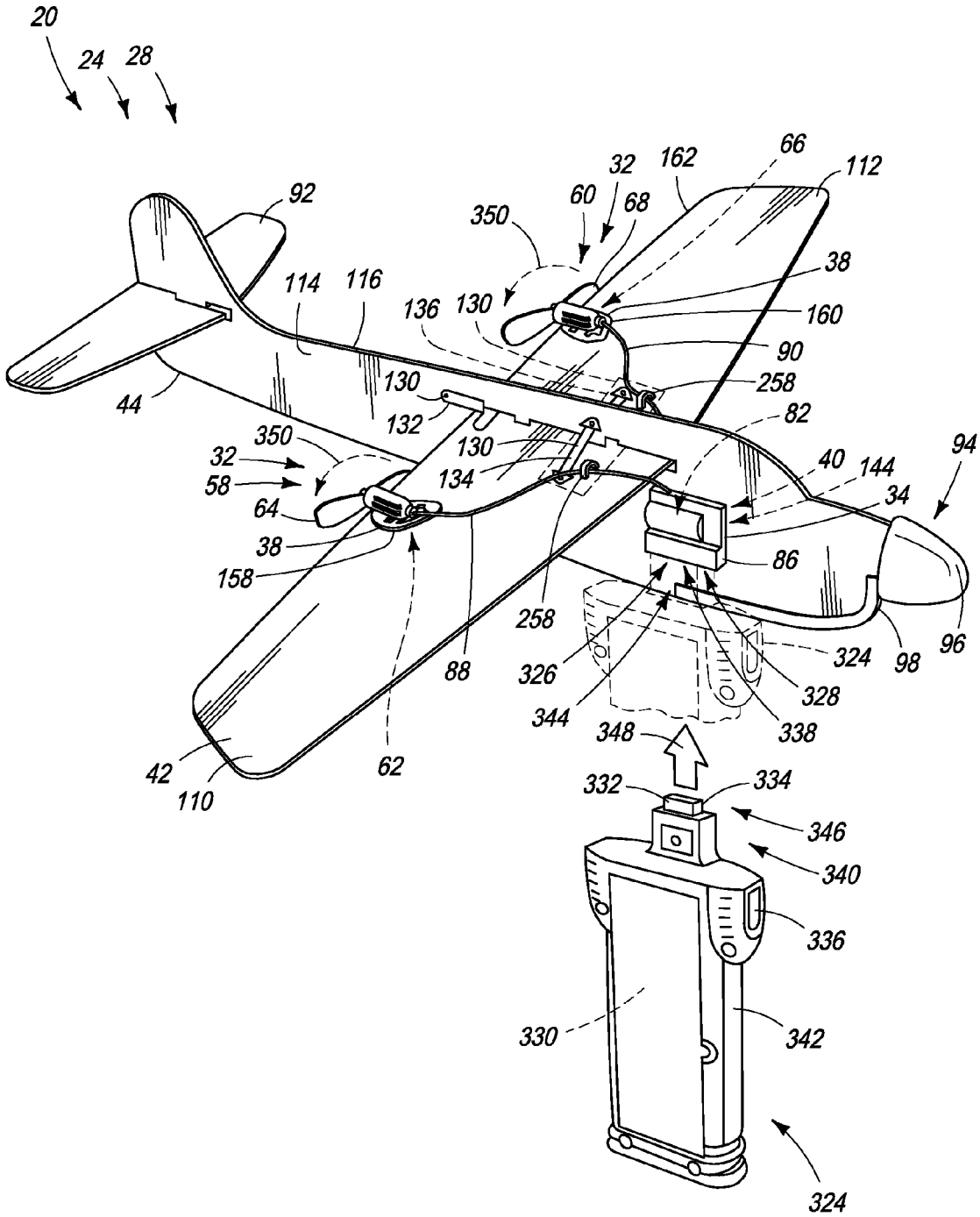
FIG. 18 is a perspective view of another embodiment of a modular toy aircraft incorporating a capacitor-based modular power system and a charging unit.

Nonexclusive illustrative examples of a charging unit 324 and a toy aircraft 20 that includes a capacitor-based modular power system 24 are presented in FIG. 18. Unless otherwise specified, charging unit 324, toy aircraft 20, capacitor-based modular power system 24, and any of their component parts may, but are not required to, contain at least one of the structure, components, functionality, and/or variations described, illustrated, and/or incorporated herein.

As shown in the nonexclusive illustrative example presented in FIG. 18, the capacitor-based modular power system 24 may include a first charging interface 338 disposed on the housing 86 of the power unit 34. The first charging interface 338 may include first and second charging contacts 326, 328, which may be electrically connected to respective ones of the first and second leads of the capacitor 82.

As shown in the nonexclusive illustrative example presented in FIG. 18, the charging unit 324 may include a second charging interface 340 disposed on the housing 342 of the charging unit 324. The second charging interface 340 may include first and second charging contacts 332, 334, which may be electrically connected to the positive and negative terminals of the battery 330. In some nonexclusive illustrative examples, the battery 330 may be at least partially disposed within the housing 342. If the charging unit 324 includes a switch 336, the switch 336 may be disposed on the housing 342 in a suitable location.

The first charging interface 338 may be configured to engage the second charging interface 340 such that the first and second charging contacts 326, 328 of the power unit 34 are placed into contact with the corresponding ones of the first and second charging contacts 332, 334 of the charging unit 324. For example, the first charging interface 338 may include a receptacle 344 on housing 86 with the first and second charging contacts 326, 328 disposed in the receptacle 344, as suggested in FIG. 18. The second charging interface 340 may include a probe 346 that extends from the housing 342 with the first and second charging contacts 332, 334 disposed on the probe 346, as shown in FIG. 18. When the probe 346 is brought into engagement with the receptacle 344, as indicated by arrow 348 in FIG. 18, the first and second charging contacts 326, 328 are placed into contact with the corresponding ones of the first and second charging contacts 332, 334. In some nonexclusive illustrative examples, the receptacle 344 may be configured to at least partially frictionally retain the probe 346 such that the first and second charging contacts 326, 328 may be more readily maintained in contact with the corresponding ones of the first and second charging contacts 332, 334.

As a nonexclusive illustrative example, the capacitor 82 may be charged by bringing the probe 346 into engagement with the receptacle 344, as suggested by arrow 248, such that the first and second charging contacts 326, 328 are placed into contact with the corresponding ones of the first and second charging contacts 332, 334. When the probe 346 is engaged in the receptacle 344, the switch 336 may be activated to enable a flow of current from the battery 330 to the capacitor 82 via the first and second charging contacts 332, 334 on the probe 346 and the first and second charging contacts 326, 328 in the receptacle 344. In some nonexclusive illustrative examples, the first and second motors 62, 66 and the capacitor 82 may be electrically connected such that the first and second motors 62, 66 drive the first and second propellers 64, 68 during charging, as indicated by the arrows 350 in FIG. 18. In some nonexclusive illustrative examples, the power system 24 and the charging unit 324 may be configured such that the first and second propellers 64, 68 increase in speed during charging and reach a maximum speed when the capacitor 82 is fully charged.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy aircraft, comprising:

an airframe; and a self-contained modular power system configured to be optionally used with the airframe to propel the toy aircraft and to be optionally used separated from the airframe, comprising:

a propulsion unit operable to propel the toy aircraft, the propulsion unit including a mounting foot;

a power unit configured to provide power to the propulsion unit to propel the toy aircraft, and remains electrically connected to the propulsion unit while the self-contained modular power system is being separated from the airframe; and a flexible connection that links the propulsion unit to the power unit and is configured to permit relative movement between the propulsion unit and the power unit;

the airframe comprising:

a wing;

a propulsion unit mount configured to removably retain the propulsion unit, the propulsion unit mount including a mount aperture, wherein the mounting foot may be removably inserted into the mount aperture and rotated to engage the propulsion unit with the propulsion unit mount; and a power unit mount spaced from the propulsion unit mount and configured to removably retain the power unit independently of the propulsion unit mount removably retaining the propulsion unit.

2. The toy aircraft of claim 1, wherein:

the airframe includes a fuselage;

the propulsion unit mount aperture includes a first receptacle disposed on the wing, and the first receptacle is configured to removably receive at least a portion of the propulsion unit; and the power unit mount comprises a second receptacle disposed on the fuselage, and the second receptacle is configured to removably receive the power unit.

3. The toy aircraft of claim 2, wherein the propulsion unit mount is configured to retain the propulsion unit in a selected one of a plurality of predetermined orientations relative to the wing, defined by a series of mechanical detents, wherein the propulsion unit generates thrust along a thrust axis and the thrust axis is substantially parallel to a lower surface of the wing when the propulsion unit is in each of the predetermined orientations.

4. The toy aircraft of claim 2, wherein the power unit mount is configured to receive the power unit in a predetermined orientation.

5. The toy aircraft of claim 1, wherein the wing comprises an extruded polystyrene foam panel and the wing is at least partially frictionally retained relative to the fuselage.

6. The toy aircraft of claim 5, further comprising at least one molded plastic clip configured to at least partially retain the wing in a predetermined position relative to the fuselage.

7. The toy aircraft of claim 6, wherein at least one of the at least one molded plastic clips is configured to induce a dihedral into the wing.

8. The toy aircraft of claim 5, wherein at least a first portion of the fuselage comprises an extruded polystyrene foam panel and at least a second portion of the fuselage comprises an expanded polypropylene foam.

9. A modular toy aircraft, comprising:

an airframe, comprising:

a fuselage having first and second sides;

a wing connected to the fuselage, the wing including first and second portions extending from respective first and second sides of the fuselage;

a first motor unit mount disposed on the first portion of the wing, the first motor unit mount including a first mount aperture;

a second motor unit mount disposed on the second portion of the wing, the second motor unit mount including a second mount aperture; and a power unit mount disposed on the fuselage; and a modular power system configured to be optionally used with the airframe to propel the toy aircraft and to be optionally used separated from the airframe, comprising:

a first motor unit including a mounting foot that may be removably inserted into the first mount aperture and rotated relative to the first motor unit mount to engage the first motor unit with the first motor unit mount;

a first propeller driven by the first motor unit;

a second motor unit;

a second propeller driven by the second motor unit;

a power unit configured to deliver current to at least one of the first and second motor units to propel the modular toy aircraft and remains electrically connected to the at least one of the first and second motor units while the modular power system is being separated from the airframe; and at least one flexible connection linking the power unit to the at least one of the first and second motor units and permitting movement of the power unit relative to the at least one of the first and second motor units;

wherein the first motor unit mount is configured to removably receive the first motor unit in at least one first predetermined orientation relative to the wing;

wherein the second motor unit mount is configured to removably receive the second motor unit in at least one second predetermined orientation relative to the wing; and wherein the power unit mount is configured to removably retain the power unit in a third predetermined orientation relative to the fuselage.

10. The modular toy aircraft of claim 9, wherein:

the first motor unit mount is configured to retain the first motor unit in a selected one of a plurality of first predetermined orientations, defined by a series of mechanical detents, the first propeller at least partially generates forward thrust for the modular toy aircraft when the first motor unit is in any of the first predetermined orientations, and the first propeller generates forward thrust along a first thrust axis that is substantially parallel to a first lower surface of the wing when the first motor unit is in each of the first predetermined orientations; and the second motor unit mount is configured to retain the second motor unit in a selected one of a plurality of second predetermined orientations, defined by a series of mechanical detents and the second propeller at least partially generates forward thrust for the modular toy aircraft when the second motor unit is in any of the second predetermined orientations, and the second propeller generates forward thrust along a second thrust axis that is substantially parallel to a second lower surface of the wing when the second motor unit is in each of the second predetermined orientations.

11. The modular toy aircraft of claim 10, wherein the first motor unit mount is configured to render the second motor unit inoperative if the second motor unit is received by the first motor unit mount.

12. The modular toy aircraft of claim 10, wherein the first motor unit mount is configured to preclude receiving the second motor unit in any of the second predetermined orientations.

13. The modular toy aircraft of claim 9, wherein the fuselage and the wing each comprise at least one extruded polystyrene foam panel, the fuselage includes an aperture configured to at least partially frictionally receive the wing, and at least one reinforcing member is provided to maintain the wing in a predetermined orientation relative to the fuselage.

14. A toy aircraft having a modular power system comprising:

an airframe, comprising;

a wing;

a first motor unit mount disposed on the wing, the first motor unit mount including a first mount aperture;

a second motor unit mount disposed on the wing, the second motor unit mount including a second mount aperture;

a modular power system comprising a first motor unit, comprising:

a first housing;

a first motor disposed within the first housing;

a mounting foot that may be removably inserted into the first mount aperture and rotated relative to the first motor unit mount to engage the first motor unit with the first motor unit mount; and a first propeller driven by the first motor;

a second motor unit, comprising:

a second housing;

a second motor disposed within the second housing;

a mounting foot that may be removably inserted into the second mount aperture and rotated relative to the second motor unit mount to engage the second motor unit with the second motor unit mount; and a second propeller driven by the second motor; and a power unit, comprising:

a third housing;

wherein the power unit is electrically connected to the first and second motors, and the power unit is configured to provide power to at least one of the first and second motors to drive at least one of the first and second propellers; and wherein the modular power system is configured to be optionally separated from and used apart from the airframe, and the power unit remains electrically connected to both the first and second motors while the power unit and the first and second motor units of the modular power system are being separated from the airframe.

15. The toy aircraft of claim 14, further comprising:

a first pair of flexible insulated electrical conducting members electrically connecting the first motor to the power unit when the modular power system is separated from and used apart from the toy aircraft; and a second pair of flexible insulated electrical conducting members electrically connecting the second motor to the power unit when the modular power system is separated from and used apart from the toy aircraft.

16. The toy aircraft of claim 15, wherein the airframe includes a fuselage and the wing has a trailing edge;

wherein the wing is configured to nondestructively removably receive the first and second motor units proximate the trailing edge and the fuselage is configured to nondestructively removably receive the power unit.

17. The toy aircraft of claim 16, wherein at least one of the first and second pairs of flexible insulated electrical conducting members is routed externally to the wing, and the wing includes at least one retention device configured to at least partially retain the externally routed one of the first and second pairs of flexible insulated electrical conducting members.

18. The toy aircraft of claim 14, wherein the power unit includes first and second leads, each of the first and second motors is electrically connected to the first and second leads of the power unit, the third housing comprises a first charging interface having first and second charging contacts, the first charging contact is electrically connected to the first lead, and the second charging contact is electrically connected to the second lead.

19. The toy aircraft as recited in claim 18;

the toy aircraft airframe further comprising:

a fuselage, the wing configured to extend from the fuselage;

a third mount disposed on the fuselage and configured to selectively removably retain the power unit; and a charging unit, comprising:

a fourth housing, wherein the fourth housing is configured to receive at least one battery; and a second charging interface disposed on the fourth housing, wherein the second charging interface includes third and fourth charging contacts, the third and fourth charging contacts are electrically connected to the at least one battery, and the second charging interface is configured to hold the third and fourth charging contacts in contact with respective ones of the first and second charging contacts when the second charging interface is engaged with the first charging interface.

20. The toy aircraft kit of claim 19, wherein the first charging interface comprises a receptacle disposed on the third housing, the second charging interface comprises a probe extending from the fourth housing, and the receptacle is configured to at least partially frictionally retain the probe therein.

* * * * *